United States Patent [19]

Kelso

[11] 3,941,184

[45] Mar. 2, 1976

[54] APPARATUS FOR MANUFACTURING SEAMLESS METAL TUBULAR PRODUCTS

[76] Inventor: John W. Kelso, 315 Euclid Ave., Dravosburg, Pa. 15034

[22] Filed: Jan. 10, 1974

[21] Appl. No.: 432,194

[52] U.S. Cl. ..... 164/270; 164/76; 164/120; 164/130; 164/132; 164/324; 164/345; 164/348; 29/33 C; 29/526.3

[51] Int. Cl.[2] ..... B22D 11/124

[58] Field of Search ..... 164/76, 120, 130–132, 164/270, 324, 345, 348, ; 29/526.3, 526.5, 33 C

[56] References Cited

UNITED STATES PATENTS

| | | | |
|---|---|---|---|
| 2,500,556 | 3/1950 | Mallach | 164/120 |
| 3,504,731 | 4/1970 | Farmer | 164/270 |
| 3,826,301 | 7/1974 | Brooks | 164/76 X |

FOREIGN PATENTS OR APPLICATIONS

| | | | |
|---|---|---|---|
| 39-2204 | 3/1964 | Japan | 164/348 |
| 45-28115 | 9/1970 | Japan | 164/76 |

*Primary Examiner*—Ronald J. Shore
*Attorney, Agent, or Firm*—Kenyon & Kenyon Reilly Carr & Chapin

[57] ABSTRACT

Seamless tubular products made of metal, particularly steel, by the apparatus and method are manufactured by casting molten metal into a round, downwardly converging mold cavity having a coaxial removable cooled core of substantially uniform diameter throughout and which is less than the cavity's minimum diameter, the metal solidifying initially where it contacts the cavity wall and the core with solidification proceeding upwardly with incidental possible formation of pipe in the upper portion of the casting. Prior to the resulting casting cooling below a forging temperature, the core is removed and replaced by a mandrel having a flaring portion and which is pressed into the casting under pressure forging the casting radially outwardly and upwardly against the mold cavity wall with consequent closing and welding of any pipe. This forging may be done while the metal within the initially solidified skin portions remains molten so that undesired segregations are also forced upwardly to the top of the resulting billet. After removal of the mandrel, this forged billet, now having a relatively thick flaring wall, is placed in a rotary tube rolling mill having a mandrel providing a converging portion fitting the flared interior of the billet, the mill then rolling the billet into a seamless tubular product. Conventional rotary tube rolling mills have conical rolling rolls, and the casting mold cavity and forging mandrel may be made with conical shapes so that the billet produced fits the mill rolls, permitting the use of a conventional tube rolling mill altered substantially only by appropriate design of the mill's mandrel and its guide shoes.

14 Claims, 33 Drawing Figures

SEC A-A'

COMBINATION PLAN VIEW
& ELEVATION

SEC. C-C' FIG. 29

SEC. B-B' FIG. 29

SEC. A-A FIG. 29

APPARATUS FOR MANUFACTURING SEAMLESS METAL TUBULAR PRODUCTS

BACKGROUND OF THE INVENTION

The manufacture of seamless steel tubes when involving the use of a rotary rolling mill, is well known.

From the casting of molten steel to the production of the ultimate product, all details involved are described by "The Making, Shaping and Treating of Steel", 7th Edition, published and copyrighted 1957 by the U.S. Steel Corporation, particularly by Chapters 20, 25 and 41 of this text. In its entirety, this text is hereby incorporated as a part of the present specification.

Conventionally a huge investment in equipment and labor is required to provide a rotary rolling mill with a hollow or tubular billet for the mill to roll into a tube of specified wall thickness and length. An ingot must be cast and its top extensively cropped to remove pipe and segregations; the ingot must be reheated and rolled into a billet which must be reheated and pierced by a piercing mill. These have been minimum requirements to obtain a billet suitable for rotary rolling. The billet produced has a thick wall which in the rotary rolling mill is thinned and normally expanded to a larger diameter.

Great economy could be obtained if molten metal could be cast directly into a hollow billet and rolled into the tubular shape desired by the rotary rolling mill, providing a sound product could be obtained and labor cost could be kept down. However, any casting involves the problem of the formation of pipe and segregations in the upper portion of the casting, the molds that would have to be used must be small as compared to a conventional ingot mold, introducing handling problems and, therefore, a high labor cost, and a casting as such is ordinarily unsuitable for processing by a rotary rolling mill. These and other factors have presented a problem which has never been solved by the industry.

SUMMARY OF THE INVENTION

The object of my invention is to solve the above problem. In other words, I have provided an apparatus and method for directly casting molten steel into the open top of a mold to produce a hollow billet suitable for feeding to a rotary rolling mill, to produce satisfactory rotary rolled tubular products without involving a high labor cost.

By my apparatus and method, steel of the desired analysis is cast into a mold cavity of inverted frusto-conical shape and formed by a metal mold of adequate strength to withstand the stress of succeeding steps. This mold cavity is shallow, having a depth substantially less than the diameter of its top, and the mold has a coaxial core of substantially smaller diameter than the bottom of the mold cavity and having the same diameter throughout excepting for draft to permit removal of the core, the latter being both removable and water cooled. Excepting for the casting, my apparatus provides for thereafter handling this mold, its core and all of the following, without requiring a labor force of any kind.

The steel solidifies initially where it is in contact with the cavity wall and the cooled core, and after this has proceeded to assure the casting maintaining its integrity but while between its skins the steel is molten, the core is removed and replaced by a frusto-conical mandrel which is pressed into the casting to forge the latter against the mold cavity wall into a billet which is shorter than its maximum diameter and having a relatively thick wall of frusto-conical shape inside and out, the mold, as previously indicated, being strong enough to resist the forging stresses. During this pressing or forging the liquid steel is forced upwardly so that any segregations appear at the top of the billet and at the same time any pipe that may be formed or which is being formed is closed with its interfaces welded together so that a billet of high integrity is obtained.

This billet is then removed and preferably with reheating is placed in the rotary rolling mill. A conventional mill may be used excepting that it must be provided with a mandrel having a tip for generally establishing the desired tube inside diameter and projecting from a conical section fitting the conical inside of the billet; also, the usual guide shoes should be appropriately shaped and positioned for guiding engagement with the exterior of the billet. Otherwise normal rotary rolling may be practiced.

To avoid labor cost and eliminate the uncertainties of manual manipulative steps, as previously noted I have provided an apparatus performing each of the various steps required by my invention by the use of mechanical devices. My apparatus incorporates a turntable carrying the mold, as one of a series of molds, passed a casting station, a core-removing station, a press or forging station and a station where the billet ready for rolling is removed from the mold and transferred to the rotary rolling mill, the core being replaced in the mold at a following station so that the mold is again ready for casting.

For practicality my apparatus involves many features contributing to reliable automated operation.

DETAILED DESCRIPTION OF THE INVENTION

My invention has the following advantages over conventional practice:

1. It makes it possible to obtain a sound, pipe-free billet by top pouring and pressing without the yield loss necessitated by cropping off the portion of the billet containing pipe and blow holes normally associated with top pouring.

2. It eliminates the conventional blooming and bar mills normally required between ingot and billet.

Figure 7:
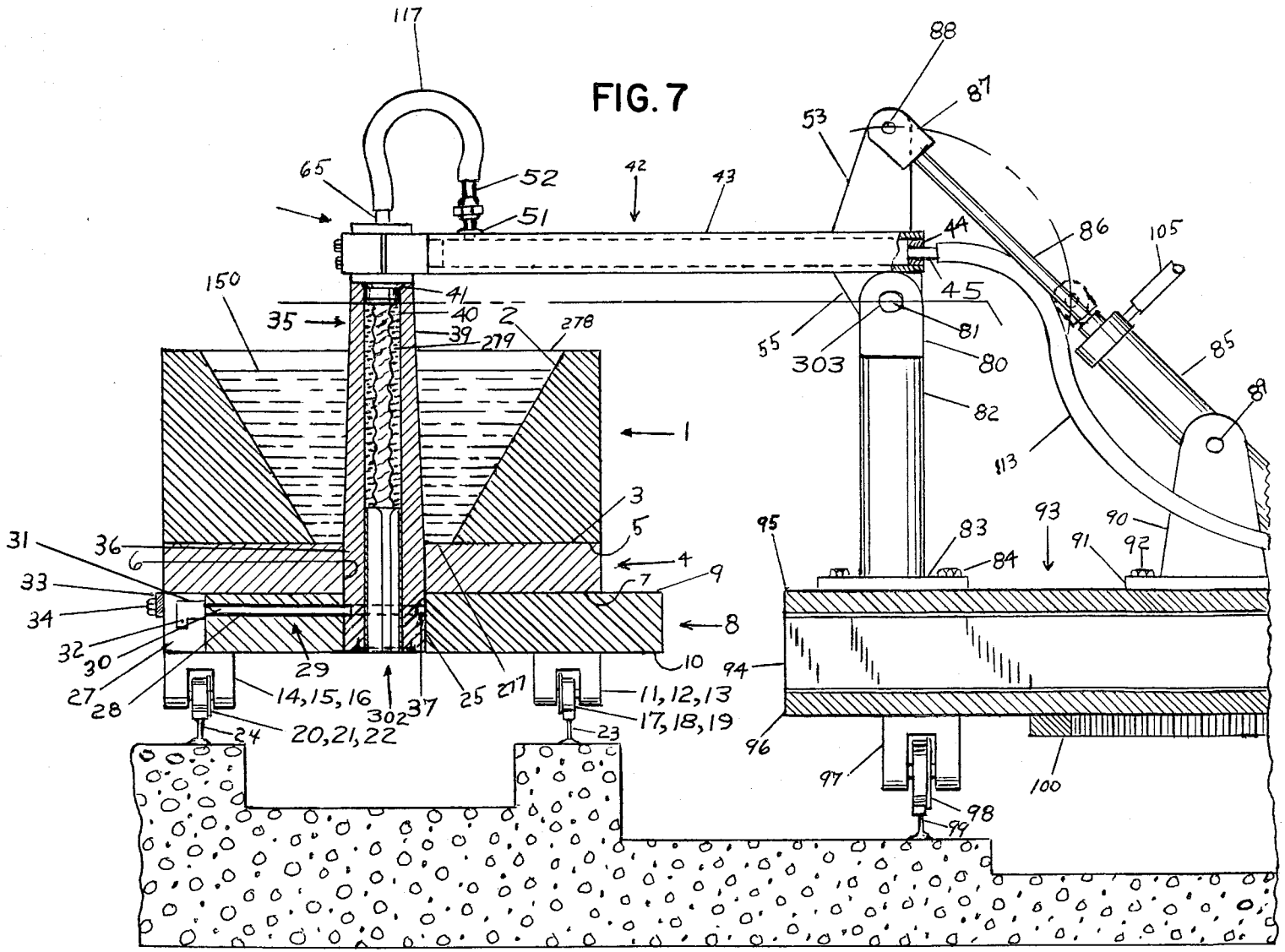
FIG. 7 is a section through the center of the mold and a portion of the turntable showing the water cooled metal core, the buggy on which the ingot and stool are mounted, the retractable cooling arm through which core cooling water is conducted to the water cooled core, and the cooling arm retracting and engaging mechanism.

Hot metal 150 from ladle 151 (FIG. 8) is poured through trough 152 into metal mold generally designated by 1. Mold 1 is mounted on stool 4, the upper surface of stool 4 being a plane, flat surface that exactly fits the bottom surface 3 (FIGS. 7 and 9) of mole 1. The bottom surface 7 of stool 4 (FIG. 7) is also plane and exactly fits the upper plane surface 9 of buggy 8 on which assembled mold 1 and stool 4 are placed.

The inner surface or cavity 2 (FIG. 7) of mold 1 is in the form of an inverted frustrum of a cone having an included angle of about 60°, the upper opening 278 being larger than the bottom opening 277.

Stool 4 is provided with a central cylindrical hole 6 which exactly coincides with cylindrical hole 25 in buggy 8.

Water cooled metal core 35 (FIG. 9), which is fitted into holes 6 and 25, is in the form of a tube which has a cylindrical section 36, a slightly tapered section 39, an inside bore 40. The cylindrical portion 36 extends downward to cylindrical section 37 of smaller diameter than section 36, the juncture forming a shoulder 38, this shoulder being located in the portion of cone 35 that extends into hole in buggy 8.

Slightly tapered section 39 of water cooled core 35 extends from surface 3 of stool 4 upward out of mold 1 to a distance above the surface of hot metal 150 where it may be connected to the cooling arm 42. The taper of section is further illustrated in FIG. 1 by $d_2$ and ($d_2$–X), X being about of the order of three quarters of an inch per linear foot. (on diameter).

Figure 1:
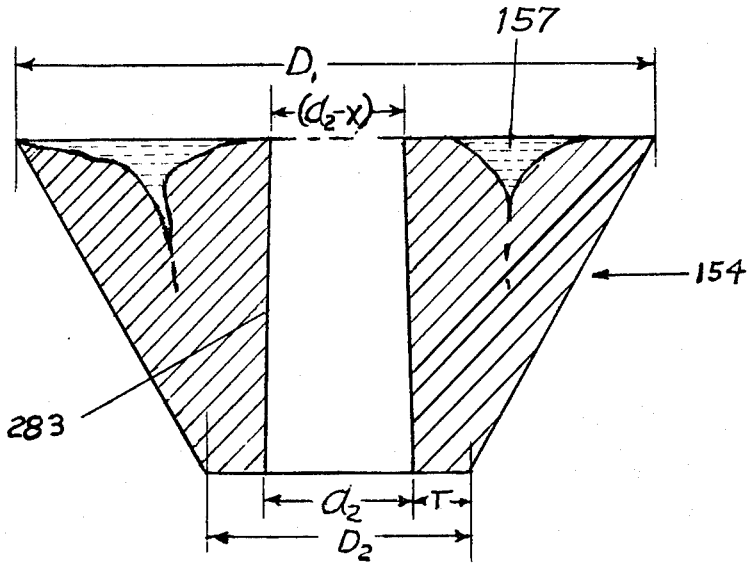
FIG. 1 is a sectional view of the cast billet if cooling were allowed to proceed to complete solidification.

Dimension $D_1$ in FIG. 1, or maximum ingot diameter, is substantially greater than the ingot axial length, $D_2$ being established by the conical angularity but being in any event substantially greater than $d_2$. The mold cavity is dimensioned accordingly.

Figure 19:
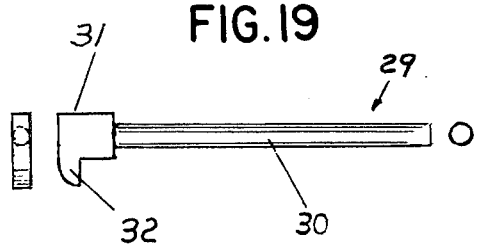
FIG. 19 shows the core positioning pin in detail.

Water cooled metal core 35 is held in position in mold 1 by key 29 (FIGS. 7, 9 and 19) which extends through slot 27 and hole 28 in buggy 8. Key 29 has a cylindrical section 28 that has a sliding fit with hole 28, a larger section 31, this section having a tang 32 on its lower edge. Key 29 is retained in pocket 27 by retainer 33 which is secured by the buggy 8 by bolts 34. The forward end 38 of key 29 contacts shoulder 38 of water cooled core 35 thereby preventing core 35 from dropping downward through holes 6 and 25.

Cooling water for metal water cooled core 35 is supplied directly through a special nozzle generally designated by 57, (FIGS. 7, 8, 17 and 18) which applies high pressure water to the inside bore 40 of core 35 in a tangential direction that causes the water to take a rapidly spinning helical path downward through core 35 while clinging tightly to the inside surface 40 as a result of its rapid spinning, this shell of water being indicated by 279.

Figure 18:
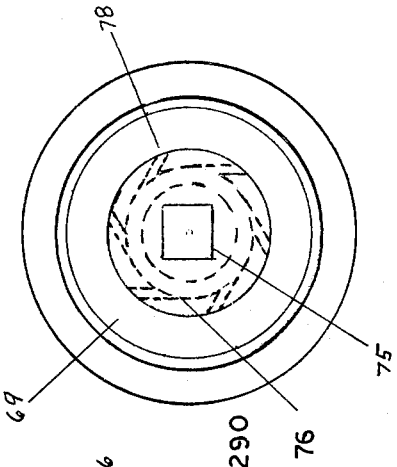
FIGS. 17 and 18 detail construction of the nozzle that imparts a swirling motion to the cooling water that makes it cling to the inner surface of the water cooled metal core.
Figure 17:
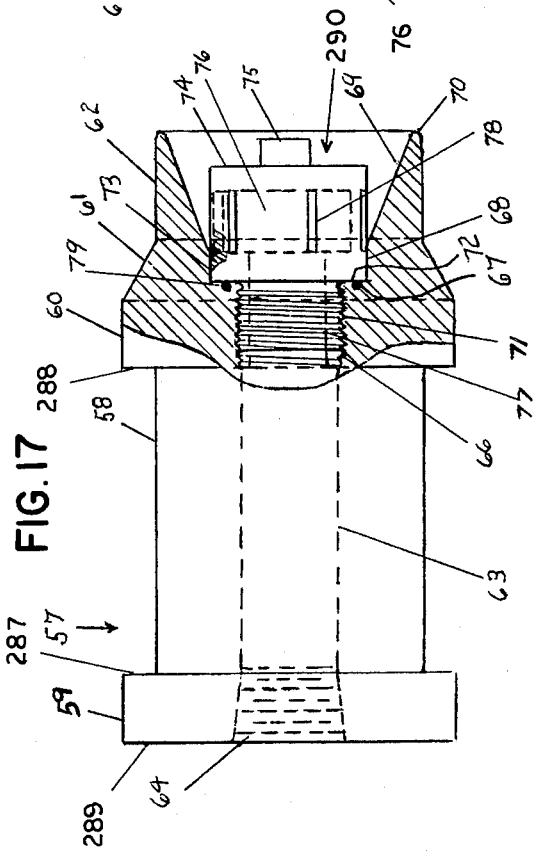

Referring more particularly to FIGS. 17 and 18 for a more detailed description of nozzle 57, the nozzle consists of a solid forging of casting having a cylindrical turned surface 58 terminated at both ends by larger diametered sections 59 and 60 which form shoulders 287 and 288 with section 58. Section 60 joins and blends with cylindrical section 62 by means of conical section 61. The center of nozzle 57 is provided with an internal conical section 69 which connects through radius 70 with surface 62, and on its inward end with cylindrical core 68, bore 68 terminating in plane surface 72 which is joined by threaded section 66 to bore 63.

Special swirling nozzle 290 is mounted in the front end of nozzle 57 by threaded section 71 whose threads engage threaded bore 66. Threaded section 71 is provided with an internal bore 77 which communicates with internal cavity 76 in cylindrical section 73 of nozzle 290, this cylindrical section terminating in cap 74 and in the rear in plane surface 72. Multiple slots 78 are machined in cylindrical section 62.

Figure 14:
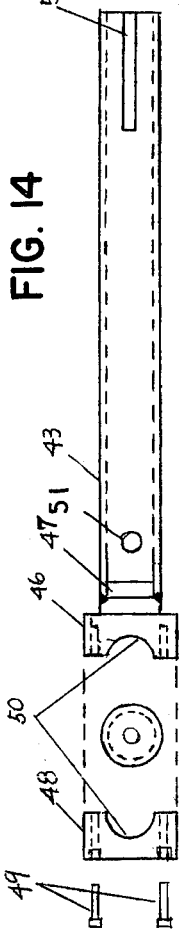
Figure 16:
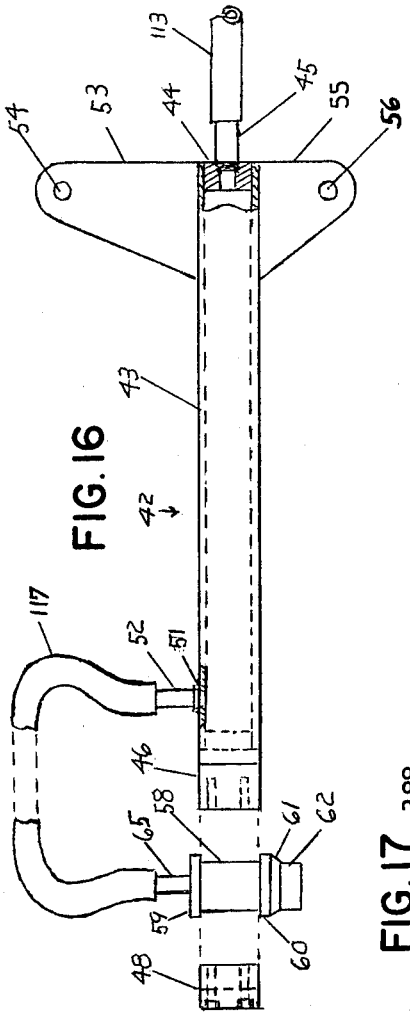

Nozzle 57 (FIGS. 7, 8, 14, 15, 16) is mounted on cooling arm 42 by being clamped between members 46 and 48 in such a way that machined surfaces 50 (FIGS. 14) engage surface 58 of the nozzle. Member 48 is bolted to member 46 by bolts 49. Member 46 is attached to tubular arm 43 by inserting tang 47 in the inside surface of 43 and welding. Tubular member 43 is provided with a tapped hole 51 into which is threaded nipple 52. One end of hose 117 is attached to nipple 52, the other end to nipple 65, this nipple being screwed into tapped hole 64 of nozzle 57. Hose 117 is arched to serve as a trap to prevent water from draining from tubular member 43 when it is desired to shut off water to stop cooling core 35. The rearward end of cooling tube 43 is stopped with plug 44, which is tapped and threaded to receive nipple 45. The rearward end of tubular member 43 is also provided with lever arm 53 and hinge member 56.

In the downward engaged position of cooling arm 42, the axis of nozzle 57 coincides with the axis of water cooled core 35 and section 62 of the nozzle fits loosely into the inside surface 40 of core 35, conical section 61 of the cooling nozzle contacting conical surface 41 of core 35, effecting a seal.

Cooling arm 42 is mounted in clevis 80 (FIGS. 7 and 8) by placing hole 56 of hinge member 55 in alignment with hole 303 of clevis 80 and inserting pin 81. Clevis 80 is mounted on column 82 which is attached to base 83, base 83 being attached to top plate 95 of table 93 by bolts 84.

Figure 8:
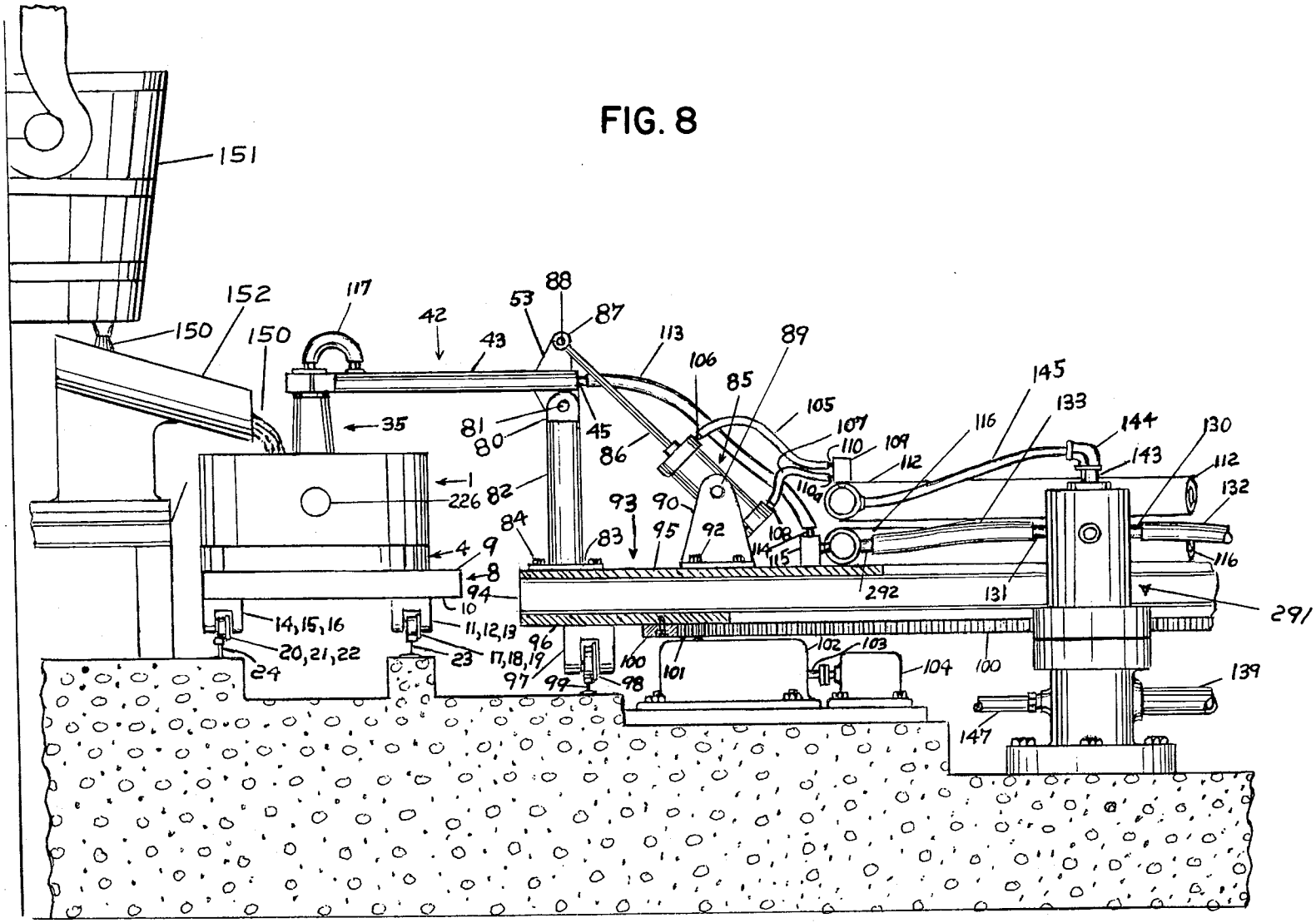
FIG. 8 is an expansion of FIG. 7, also in vertical section, showing air and water manifolds, the air and water separator, air and water ducts and connecting hoses, means of rotating the turntable, means of pouring the billets, rails carrying the buggies, and the rail supporting the outer section of the turntable.
Figure 9:
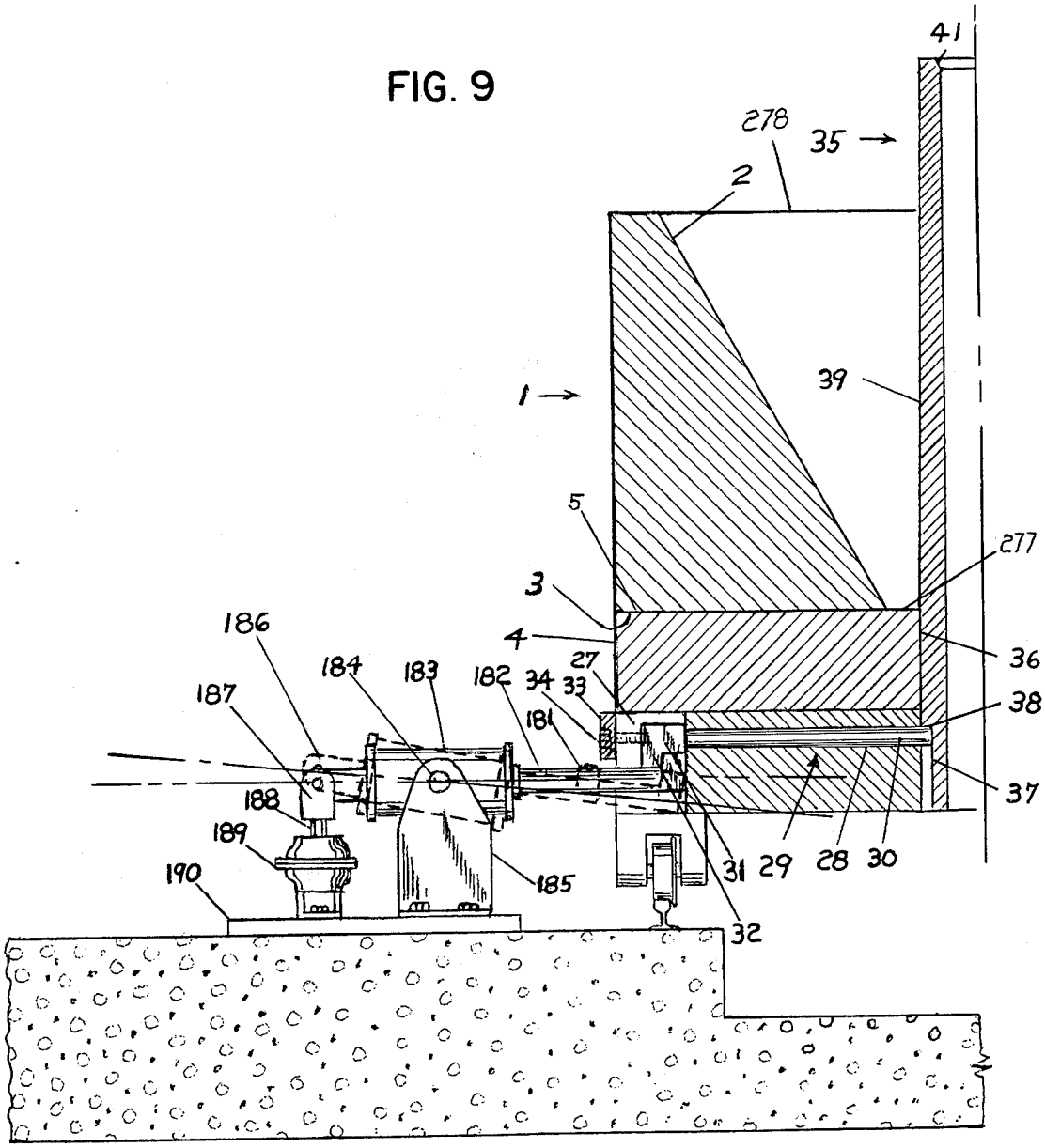
FIG. 9, in vertical section, shows the pin that supports the metal water cooled core in the center of the mold, and the means of engaging and retracting this pin.
Figure 22:
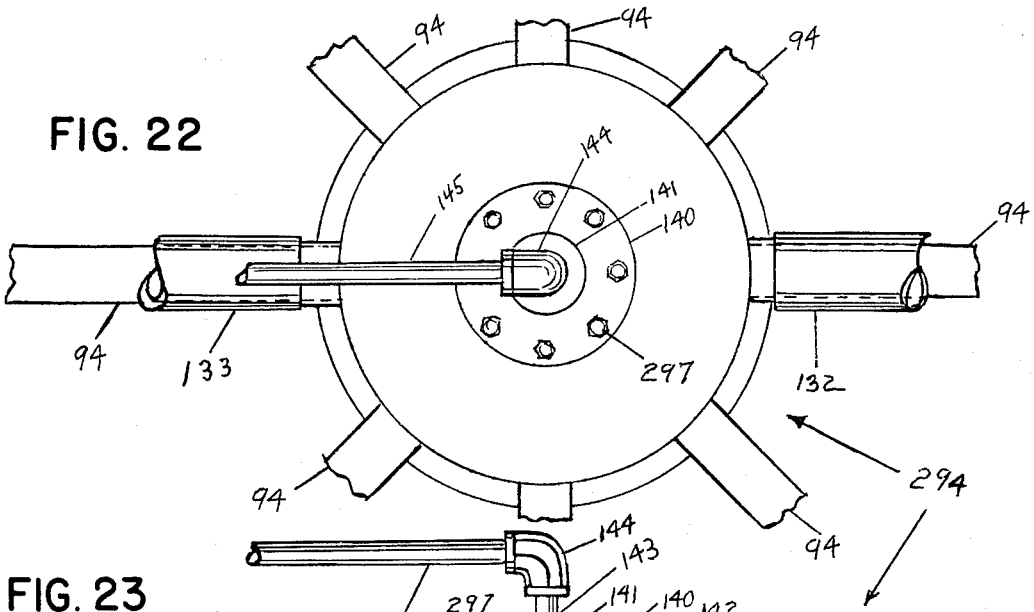
FIGS. 22 and 23, in plan and vertical section, respectively, detail the rotating separator that supplies air and water to the turntable and serves as the central hub bearing of the turntable.

Cooling arm 42 is actuated upward and downward as follows: (FIGS. 7 and 8) lever arm 53 is attached to clevis 87 by pin 88, clevis 87 being attached to piston rod 86 of cylinder 85, cylinder 85 being mounted through trunnions 89 to frame 90 which is attached to table 95 by bolts 92. Cylinder 85 is actuated in the draw action by introducing air from 4-way electromagnetic valve 109 (FIG. 8) through nipple 110, through attached hose 105, through nipple 106 to the front end of cylinder 85. In the reverse action, air is introduced through another part of electromagnetic valve 109 through nipple 110*a*, through hose 107, through nipple 108 to the opposite side of the piston. Air to valve 109 is supplied by ring manifold 112 which in turn is supplied with air through pipe 145 which is attached by swiveling elbow 144 which is attached to air pipe 143 of air and water separator 291 (FIGS. 8 and 22).

Water to cooling arm 42 is supplied by hose 113 which is attached by nipple 114 to electromagnetic water valve 115 at its rearward end, and to cooling arm 42 by nipple 45. Water valve 115 is connected to ring water manifold 116, the manifold in turn being supplied through hoses 132 and 133, these hoses being attached to the manifold by nipples 130 and 131.

AIR AND WATER SEPARATOR

Figure 23:
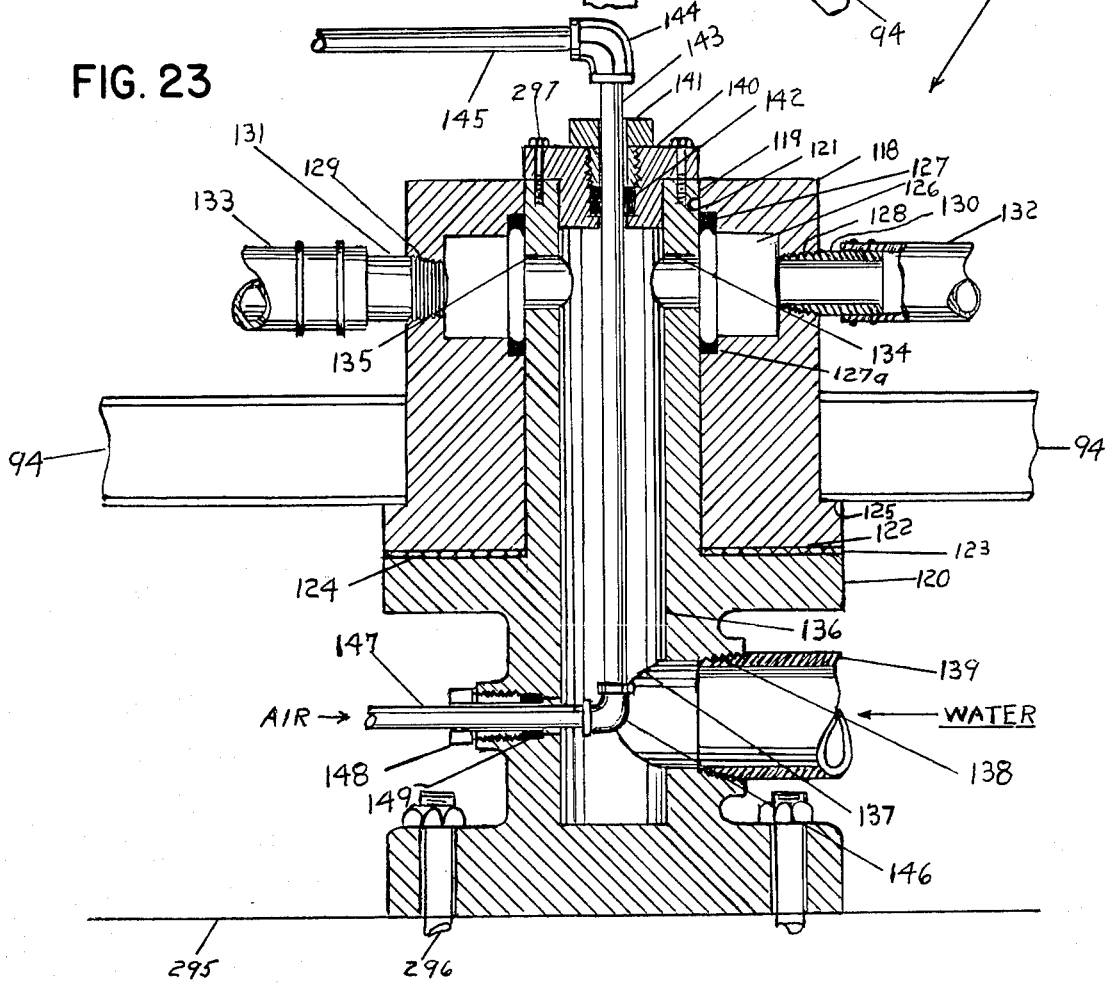

Air to operate cylinder 85 and water to cool the water cooled core 35 must be supplied to a rotating table 93 from stationary sources. This is accomplished by means of an air and water separator generally designated by 291 (FIGS. 8, 22, 23). The air and water separator consists of a stationary member 120 which is bolted to foundation 295 by bolts 296. Stationary member 120 is provided with an interior central core 136 which communicates with port 137 which admits water from an exterior supply source through a pipe 139 which is screwed into threaded portion 138 of port 137. Internal core 136 also communicates with ports 134 and 135 located in the upper portion of stationary member 120. Core 136 is closed off in its upper extreme end by plug 140 which is bolted to 120 by bolts 279.

Air is introduced to separator 294 through air supply pipe 147 which enters 120 through packing gland 148 and is sealed from the interior 136 by packing 149. Supply pipe 147 is connected to pipe 143 by elbow 146. Pipe 143 is sealed from the interior 136 of 120 by packing gland 141 and packing 142. Pipe 143 is connected to pipe 145 by rotating elbow 144.

Water, supplied to stationary core 136 under pressure through port 137, is introduced into annular cavity 126 in rotating member 118 through ports 134 and 135, and from this annular cavity to hoses 132 and 133 by way of nipples 130 and 131 which are screwed into ports 128 and 129.

Rotating member 118 is provided with a machined circular bottom surface 122 which rests on bearing 123, bearing 123 resting in turn on machined flange of stationary member 120. Rotating member 118 is provided with a machined inner cylindrical surface 119 that is dimensioned to give a bearing fit with surface 121 of stationary member 120 and these two surfaces are sealed from the outside by packing rings 127 and 127*a*.

Air and water separator 294 also acts as the center hub bearing of table 93 for the reason that structural members 94 rest on projection 125 of rotating member 118 and are fastened to it.

TURNTABLE

Turntable 93 (FIGS. 7, 8, 23) consists of structural members 94, which are secured as stated above to rotating member 118, these structural members 94 extending radially outward to a uniform distance and carrying on their upper surface top plate 95 which forms a ring shaped top surface on which are mounted column 82, frame 90 and manifolds 112 and 116. Bottom plate 96 is attached to the under side of structural members 94, forming the ring shaped surface on which are mounted ring gear 100, wheel mounts 97 that carry flanged wheels 98 which support the outer circumference of table 93, these wheels riding on circular track formed by rail 99.

Table 93 is rotated by pinion 101 which is meshed with ring gear 100 and is driven through gear box 102 and shaft 103 by motor 104.

Buggies 8 (FIGS. 7, 8, 30), which carry molds 1 and stools 8 on their upper surfaces 9, are carried on rails 23 and 24 which form a circular track having the same center as table 93 by means of flanged wheels 17, 18, 19, 20, 21 and 22, these wheels being journaled and axled in mounts 11, 12, 13, 14, 15, and 16 mounted on the under side 10 of buggies 8. Buggies 8, which are coupled together by couplings 298, 299, and pins 300, are moved around the circular track formed by rails 23 and 24 by being linked to turntable 93 through bars 191 (FIGS. 11, 30) these bars being pinned to hinge plate 192, hinge plate 192 being bolted to top plate 95 of turntable 93. In the down position, bars 191 rest on top surface 9 of buggies 8 between lugs 193 which are fastened to the top surface 9 of buggies 8. When turntable 93 is rotated, this motion will be imparted to buggies 8 through hinge member 192, bar 191 and lugs 193 to buggies 8.

THE CASTING, COOLING, CORE REMOVING AND PRESSING OPERATIONS

Figure 20:
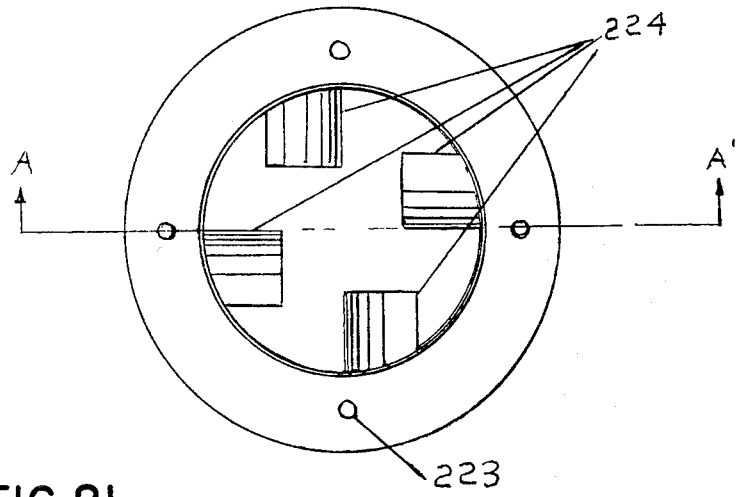
FIGS. 20 and 21, in plan and elevation views, respectively, show construction of the chamber that converts the swirling motion of the core cooling water into linear flow parallel to the axis of the water cooled core.
Figure 21:
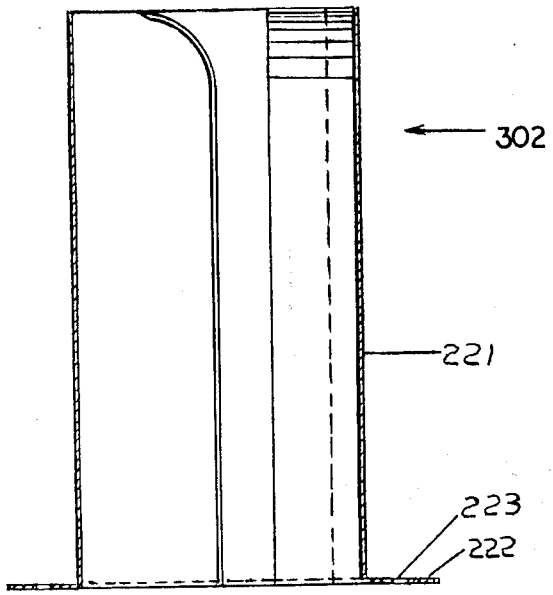

Assume turntable 93 to be indexed counterclockwise for purposes of description so that the train of buggies is always moved in a counterclockwise direction. As each buggy 8 is indexed to a position at the exit end of stripping table 230 or at the entering end of pouring table 153, a mold 1 is placed in position on its stool 4 and buggy 8, and core 35 is placed in position in the center of mold 1 and key 29 is moved forward against cylindrical section 37 and shoulder 38 of core 35. Cooling arm 42 is lowered into horizontal position by action of cylinder 85. The buggies 8 are then indexed one buggy length and each loaded as above until the first of the buggies reaches pouring station 301 of pouring platform 153 (FIGS. 30) under the auxiliary pouring trough 152. High pressure cooling water is then admitted through valve 115 to hose 113, through cooling arm 43, through hose 117 through nozzle 57 to the interior 40 of core 35 where it continues in a spiral path 279 downward through the interior 40 of core 35, clinging tightly to the interior surface 40 until it is discharged through nozzle 302 (FIGS. 7, 20, 21) which converts the circular flow of the water to linear flow in a direction parallel to the axis of core 35 so that the water will flow directly to the foundation 295 instead of in a direction parallel to the bottom surface 10 of buggy 8 making it difficult to collect and discharge for recirculation.

Nozzle 302 (FIGS. 20 and 21) consists of cylindrical section 221 of which the diameter is such that it will fit closely into the inside bore 40 of nozzle 35. Flange 222 is attached to section 221 and has holes 223 for bolting to the bottom of core 35. Diversion of the cooling layer 279 of water from spiral to linear flow is accomplished by vanes 224 which are curved at their upper ends, the direction of the curve being toward the direction of flow of water 279.

When the first buggy 8 is in pouring position, hot metal 150 is poured from ladle 151 through auxiliary trough 152 directly into mold 1 until the desired level is reached and the hot metal shut off. The buggy is then indexed, one position bringing the next mold into pouring position.

Figure 3:
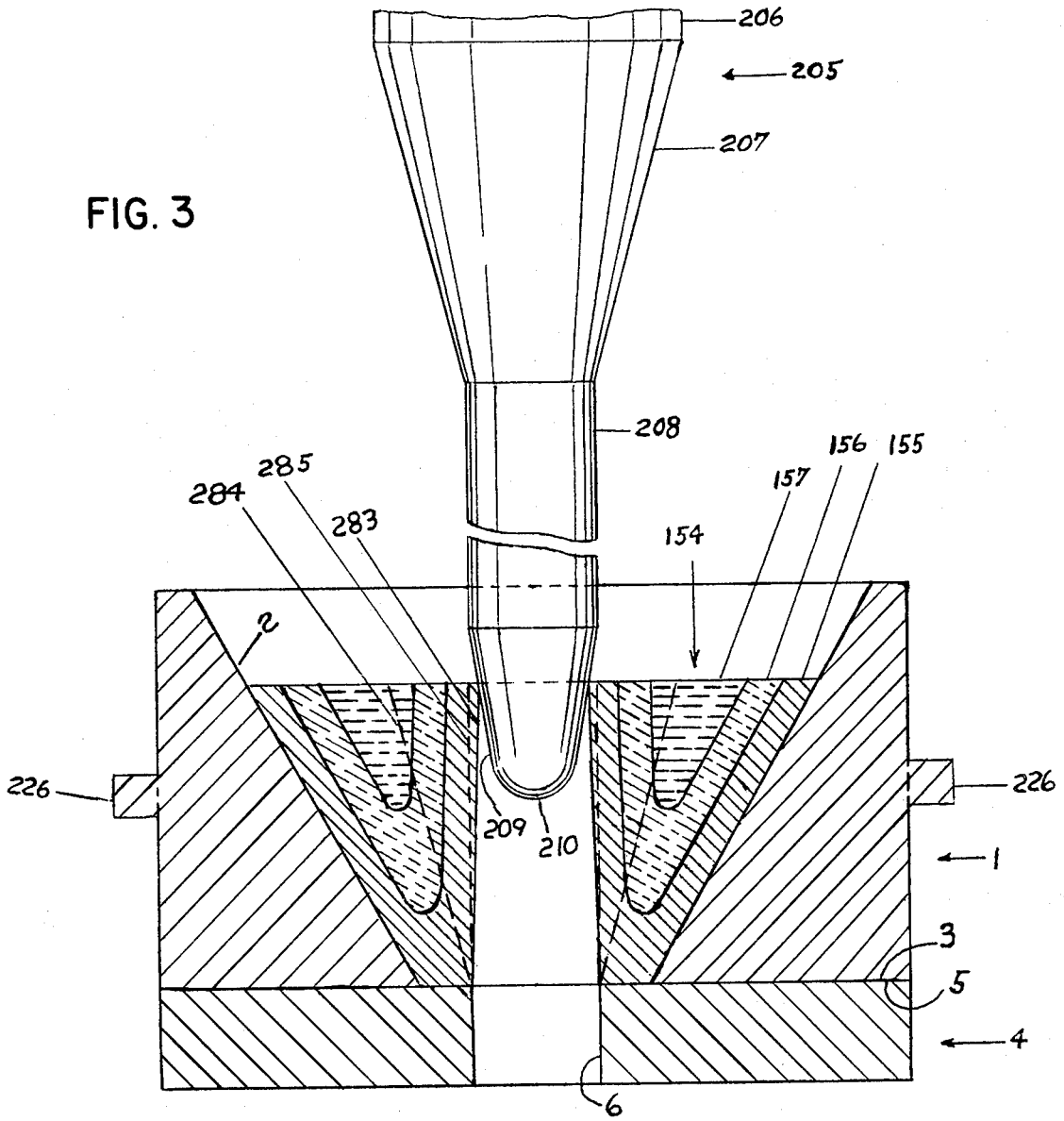
FIG. 3 is a cross section of mold and cast billet showing progressive structural changes on cooling and the profile after pressing in the mold.
Figure 11:
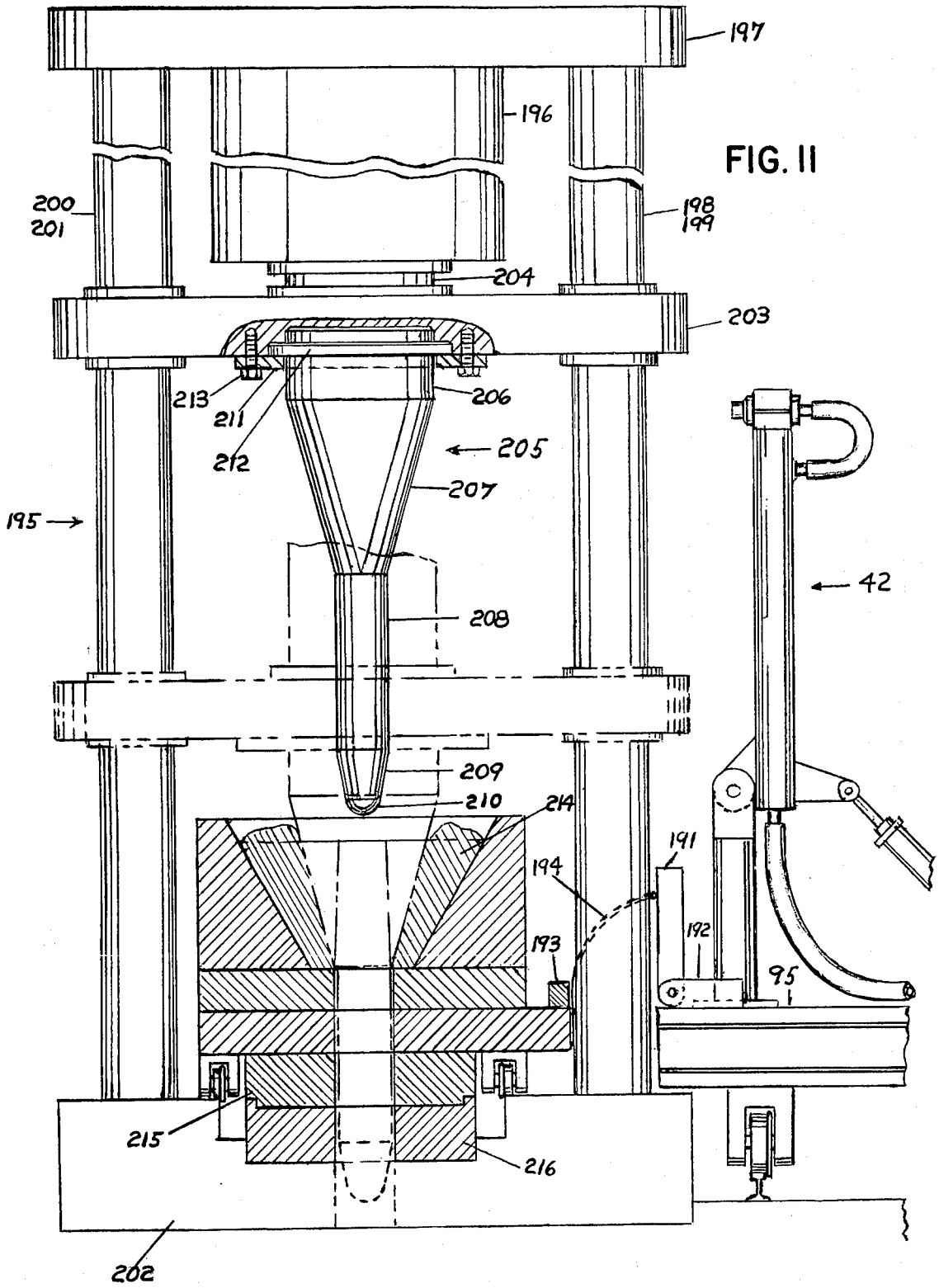
FIG. 11, in vertical section, shows the press that straddles the circular track carrying the buggies, one of the towing bars in raised position, one of the cooling arms in raised position, the wedge under one of the buggies in engaged position, the pressing ram, and the actuating cylinder.

Cooling begins at once as illustrated in FIG. 3. Metal in contact with the interior surface 2 of mold 1 begins to solidify by the heat absorbing action of the metal mold, and in the center by contact with the outer surface of water cooled core 35 resulting in a solid section of metal 155, a semi-solid section 156, and a liquid portion 157 consisting of a mixture of metal and impurities which have a melting point lower than that of the cast metal. When portion 155 is cooled enough so that the center portion, shell 155 has sufficient column strength to resist collapse under the action of core removal, but still sufficient plasticity for forging, the ingot will have reached a location one station ahead of location 158 under core removing hammer 159. The flow of cooling water, which has been maintained up to this point at a rate that will maintain the surface of the metal core in contact with the cast metal between 1600° and 1900° F., is now increased to reduce the temperature of the metal core as near as possible to the ambient temperature of the cooling water, which causes the metal core to shrink away from contact with the inside of the casting, at which time the cooling water will be shut off and cooling arm 42 raised to vertical position (FIG. 11). The correct temperature of the casting necessary to achieve the proper combination of structural strength and plasticity for core removal is obtained by selecting the pouring position on platform 153 and the above described control of the rate of flow of the cooling water.

When buggy 8 has been indexed under hammer 159, pin 29 is withdrawn as follows: (FIG. 9) Cylinder 183, mounted on frame 185 by trunnions 184 is tilted downward by action of air cylinder 189 through piston 188 which is linked to cylinder projection 186. Piston rod 182 is then moved forward until tang 181 is directly under tang 32 of key 29, after which cylinder 183 is tilted upward by reverse action of cylinder 189 causing tang 181 to engage tang 32. Piston rod 182 is then moved backward withdrawing rod 28 from contact with offset 38 which leaves core 35 free to be driven downward from mold 1 through hole 25 in buggy 8.

Figure 10:
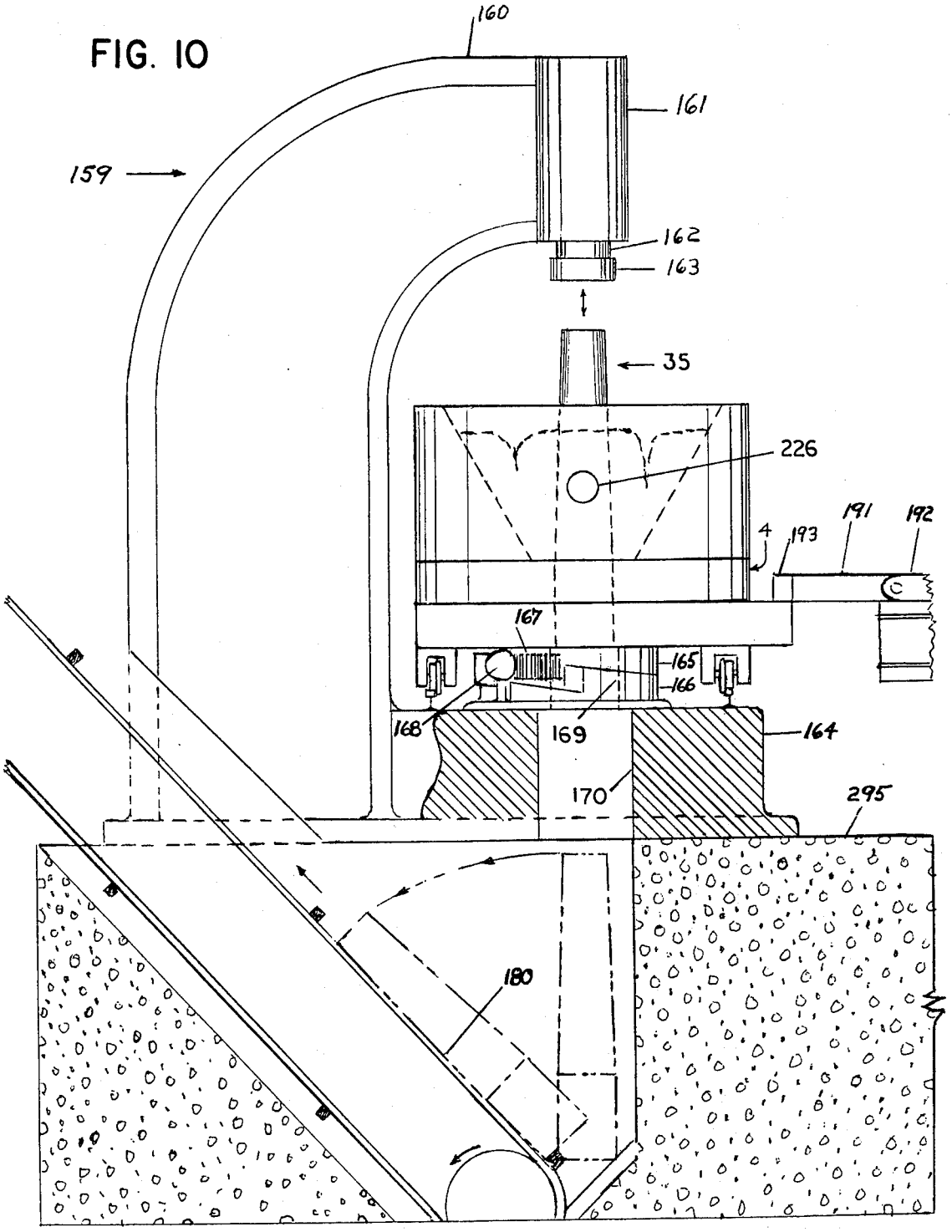
FIG. 10, in vertical section, shows the hammer for driving the water cooled core downward from the casting to a conveyor that returns the core to the surface; one of the hinged drive bars that connect the turntable to the buggies and tow them around the circular track.

The column strength of the center portion 155 of the casting is now sufficient to withstand the force of dislodging core 35 from contact with center 283 of the casting and driving it downward through hole 36 in stool 4, and hole 25 in buggy 8 to conveyor 180 (FIG. 10) which returns it to the surface. This is accomplished by hammer 159 (FIG. 10) which represents a conventional air or steam hammer consisting of a cylinder mounted on a cantilevered frame 160. Piston 162 mounted conventionally in cylinder 161 carries hammer head 163 on its lower end located directly over the center line of water cooled core 35. Slight taper or "draught" on core 35 makes it possible for a sharp blow from the hammer to break contact between core 35 and the interior of the casting, and continued blows will move the core downward as described above.

During the core removing operation, the force of the hammer is taken directly from buggy wheels 17–22 inc. and transmitted directly to frame 164 of the hammer 159 through a circular wedge assembly consisting of stationary member 166 and rotating member 165, member 165 being rotated by the action of worm pinion 168 on gear teeth 167 which are machined on upper wedge section 165. Rotation of upper member 165 causes this section to move upward against the bottom of buggy 8.

PRESSING OPERATION

After the core 35 is removed, the buggy is indexed past observation platform 286, where the temperature of the inside surface of the casting may be observed and controlled by spray cooling if necessary to prevent a breakout of molten metal. As the buggy moves toward the press, drive bar 191 of this particular buggy is raised out of engagement with lugs 193 by bearing against the rising slope of cam 194 so that buggy 8 may pass between columns 198, 199, 200 and 201 of press 195 (FIG. 11). Press 193 is a conventional hydraulic press consisting of a top member 197 which is mounted on the upper end of four columns 198, 199, 200, 201, these columns being attached to base 202. Cylinder 196 is mounted in inverted position on the under side of top member 197 and contains piston 204 which is attached to sliding platen 203. Mandrel 205 is attached to the under side of platen 203 by retainer ring 211 and bolts 213 which bear against flange 212 of mandrel 205 and draw it tightly against the under side of sliding platen 203.

Figure 2:
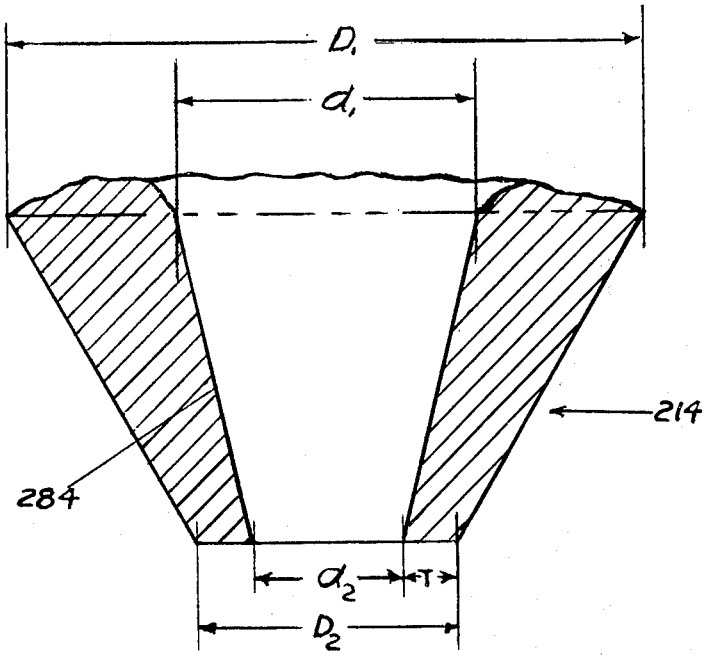
FIG. 2 is a sectional view of the cast billet after partial cooling and pressing.
Figure 4:
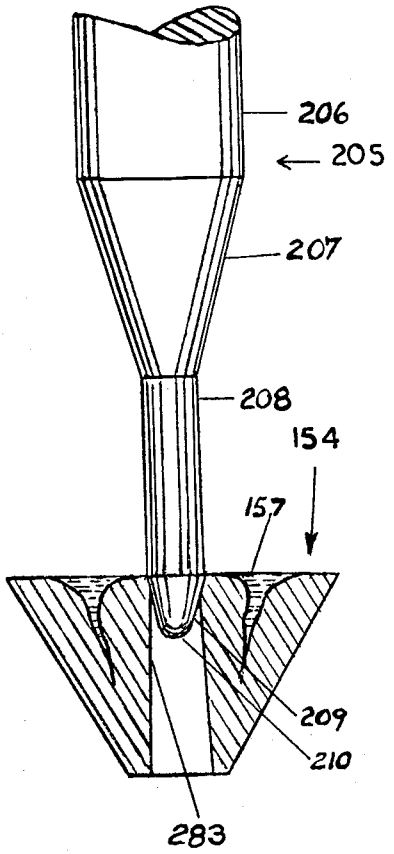
FIGS. 4, 5 and 6, in vertical section, respectively summarize the pressing or forging operation.
Figure 5:
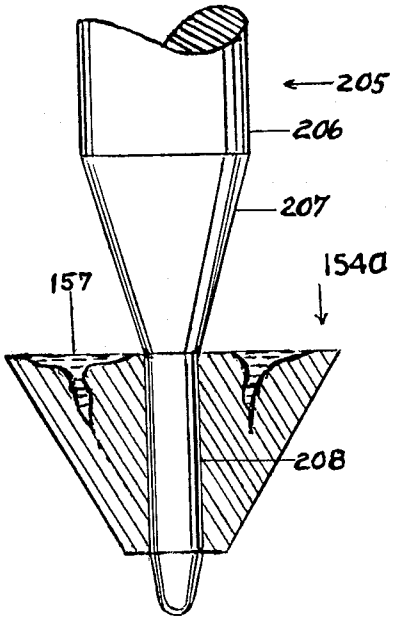
Figure 6:
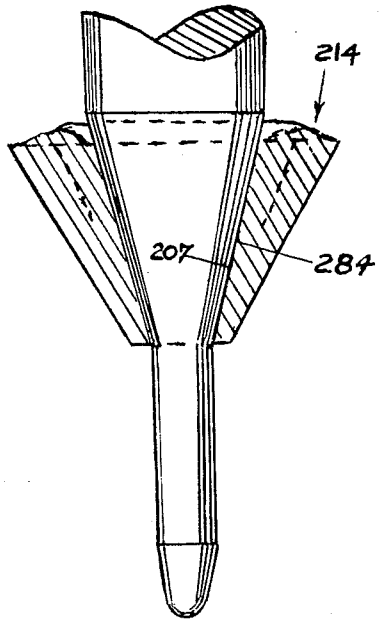

Mandrel 205 consists of a lead-in cone 209 which terminates in radius 210. Lead-in cone 209 joins cylindrical section 208 and cylindrical section 208 joins conical section 207, conical section 207 terminating in cylindrical section 206 on which flange 212 is machined. The diameter of cylindrical section 208 of mandrel 205 is slightly smaller than diameter $d_2$ (FIGS. 1 and 2) and will have a sliding fit with hole 6 of stool 4 and hole 25 of buggy 8. When buggy 8 has been indexed into pressing position under the mandrel of press 195, the center lines of mold 1, hole 6 of stool 4, hole 25 of buggy 8 and mandrel 205 will exactly coincide and mandrel 205 may be removed downward by action of cylinder 196 to effect the pressing and forming action shown in FIGS. 4, 5 and 6 (shown without mold which is assumed to be in place). Before section 208 of mandrel 205 enters partially cooled casting 154, the central cavity 283 is slightly tapered by being formed against water cooled core 35. The cylindrical section 208 of mandrel 205 converts this central cavity into cylindrical form (FIG. 5). The mandrel 205 continues to move downward until conical section 207 forms inside profile 284 (FIGS. 2, 3) having the same profile as 207, the pressure and metal displacement of this operation causing the unsolidified mixture of metal and impurities in cavity or pipe 157 to be extruded upward and out of the casting 154*a* and pipe 157 and any accompanying blowholes to be eliminated. Casting 154*a* is now converted into solid billet 214, which is now ready for reheating and rotary rolling. The final dimensions of billet 214 will be such that the outside portion is a cone of approximately 60° and diameter $d_1$ will be about one half the diameter $D_1$.

Figure 12:
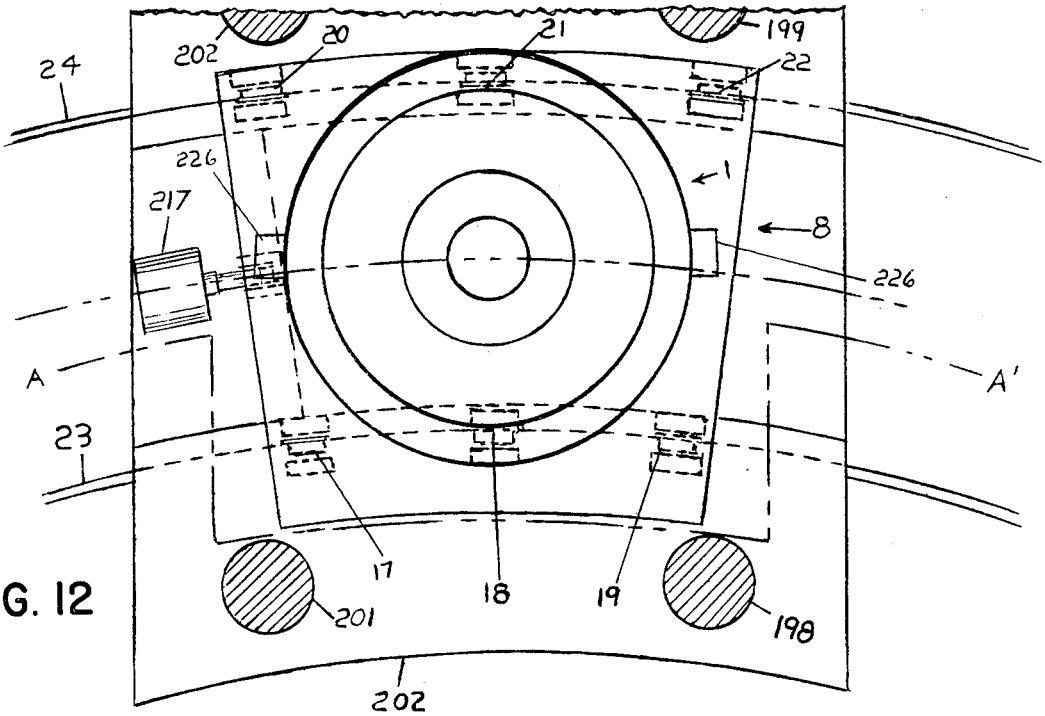
FIGS. 12 and 13, in horizontal and vertical section, respectively, show the buggy supporting wedge in more detail and the means of actuating it into and out of engagement with the bottom of the buggy under the ram of the press.
Figure 13:
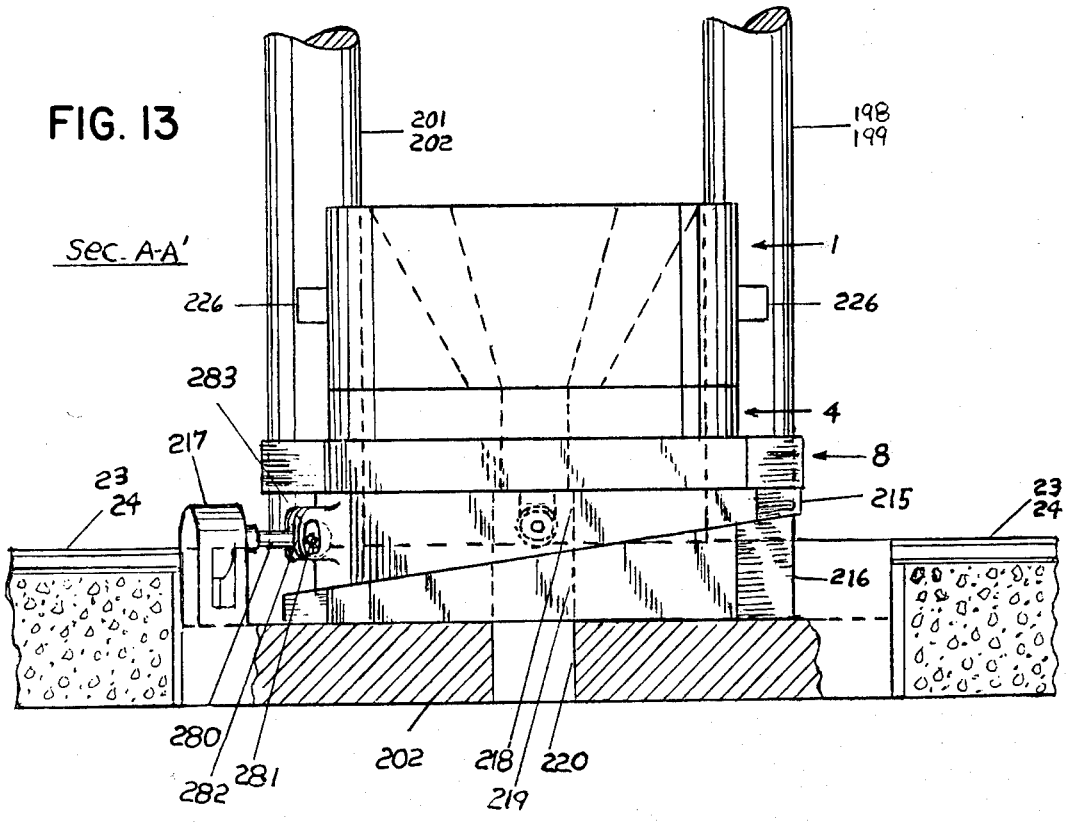
Figure 15:
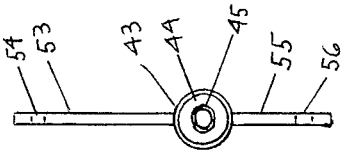
FIGS. 14, 15 and 16 show details of the core cooling arm.

In order to prevent transferring the stresses of the pressure operation being transmitted to the wheels and bearings of buggies 8, a movable wedge 215 (FIGS. 12, 13) is brought into contact with the under side of buggy 8 by moving it forward over stationary wedge member 216 by action of cylinder 217 mounted on foundation 202, this cylinder being linked to movable wedge member 216 by piston 280, clevis 282 and pin 281.

Figure 25:
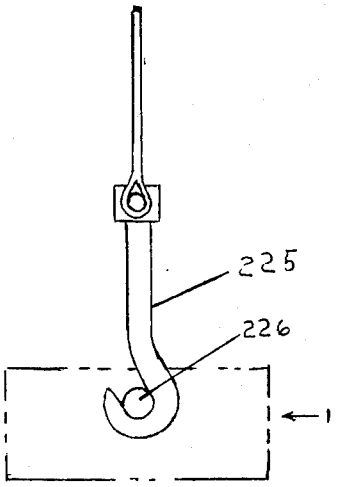
FIGS. 24, and 25, in elevation, illustrate the lifting of the mold containing the pressed billet to the stripping device.
Figure 24:
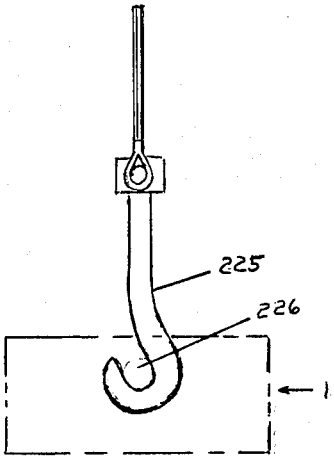
Figure 26:
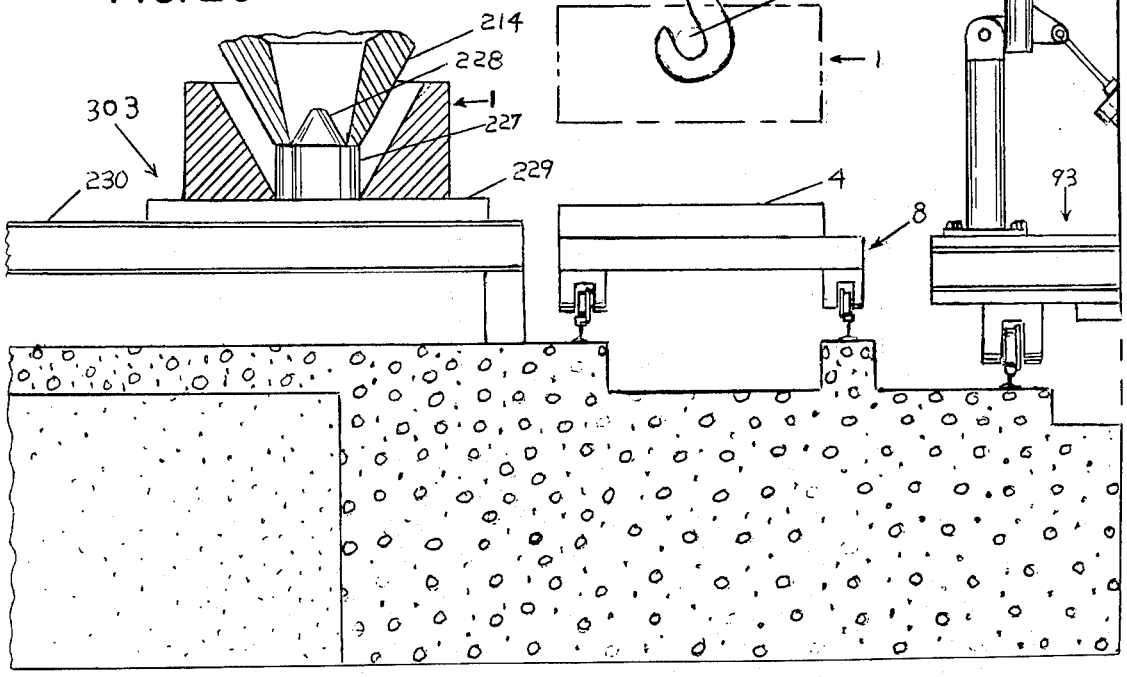
FIG. 26, in vertical section, shows the stripping device.
Figure 30:
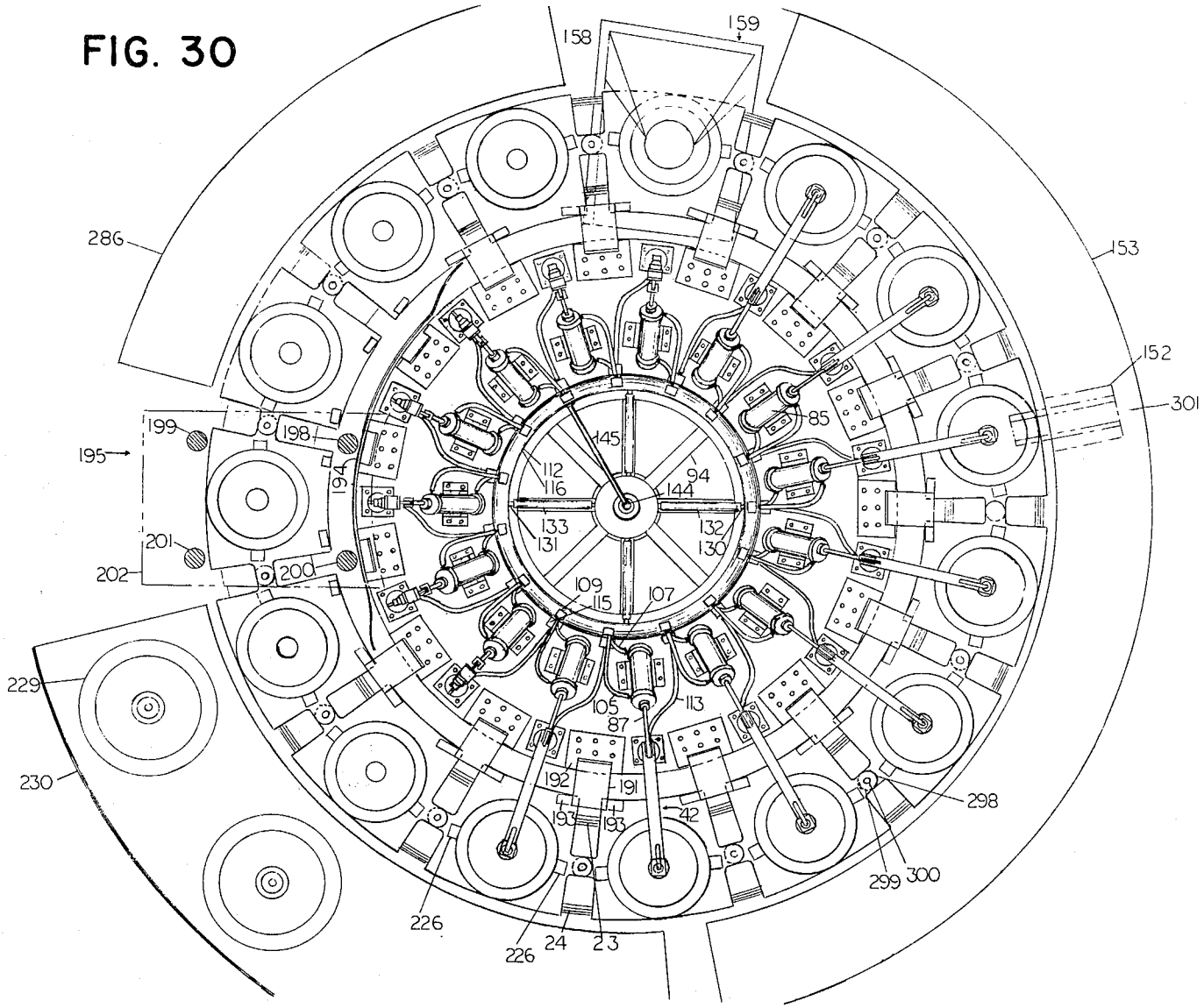
FIG. 30 is a plan view of the entire assembly of the table and buggies with an indication of the various operating and servicing stations.
Figure 33:
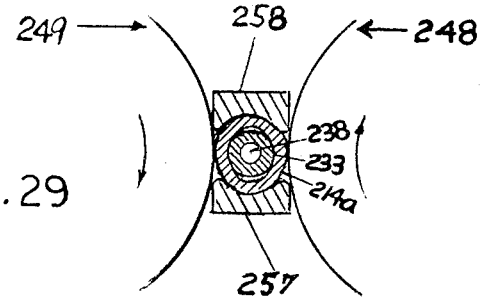
FIG. 33 is a section at the roll "gorge", section C–C′, at which point cross sectional reduction is complete and the finished seamless hollow is "reeled" from the mill pass.
Figure 32:
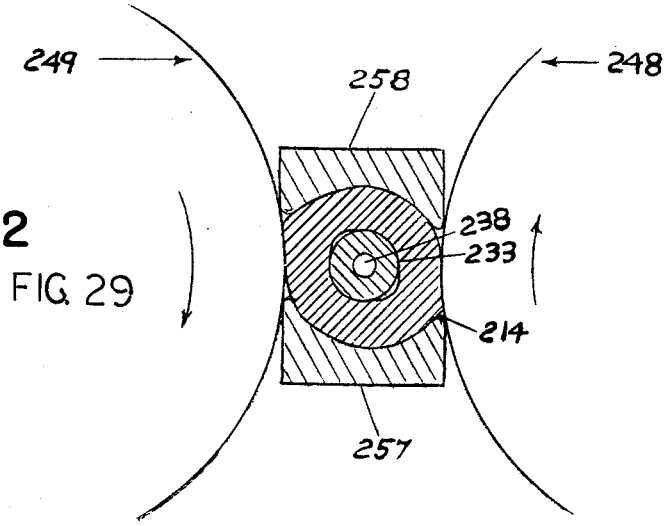
FIG. 32 is a section at B–B′ and represents the cross sectional profile of the billet half way through the pass.
Figure 31:
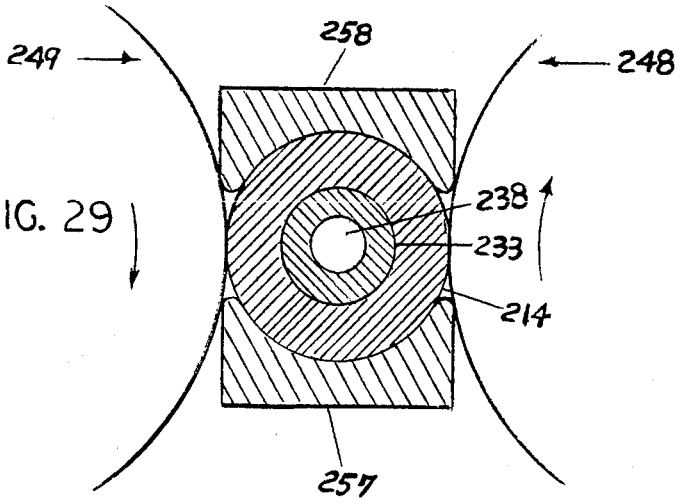
FIG. 31 is a transverse section through the pass at sec. A–A′, the point of first contact between the billet and mill pass.

After the pressing operation has been completed, the mandrel raised and the wedges disengaged from the underside of the carriage, the buggy is indexed to bring the one carrying the pressed billet out of the press and in front of stripping platform 230 (FIGS. 25 and 30). Mold 1 is lifted by crane attached hooks 225 and moved directly over stripping stool 303. Stripping stool 303 consists of a cone 228 having a bottom diameter slightly smaller than the diameter $d_2$ (FIG. 2) of the bottom hole of billet 214, this cone 228 being mounted on pedestal 227 which is attached to base 229. When mold 1 is lowered to base 229, billet 214 is raised from contact with inside surface 284 (FIG. 2) of billet 214 and may then be lifted from the table 230 to storage, conditioning or directly to a reheating furnace in preparation for rotary rolling to a tubular seamless hollow.

As the buggy is indexed past the stripping position, raised drive arm 191 (FIG. 30) encounters the downward sloped portion of cam 194 and returns to drive position in contact with lugs 193. Core 35 is replaced and locked into position by pin 29, and cooling arm 42 lowered into contact with core 35 ready for further casting.

THE ROTARY ROLLING PROCESS

The Rotary Rolling Mill pass consists of three essentials: rolls, mandrel and guide shoes.

Figure 27:
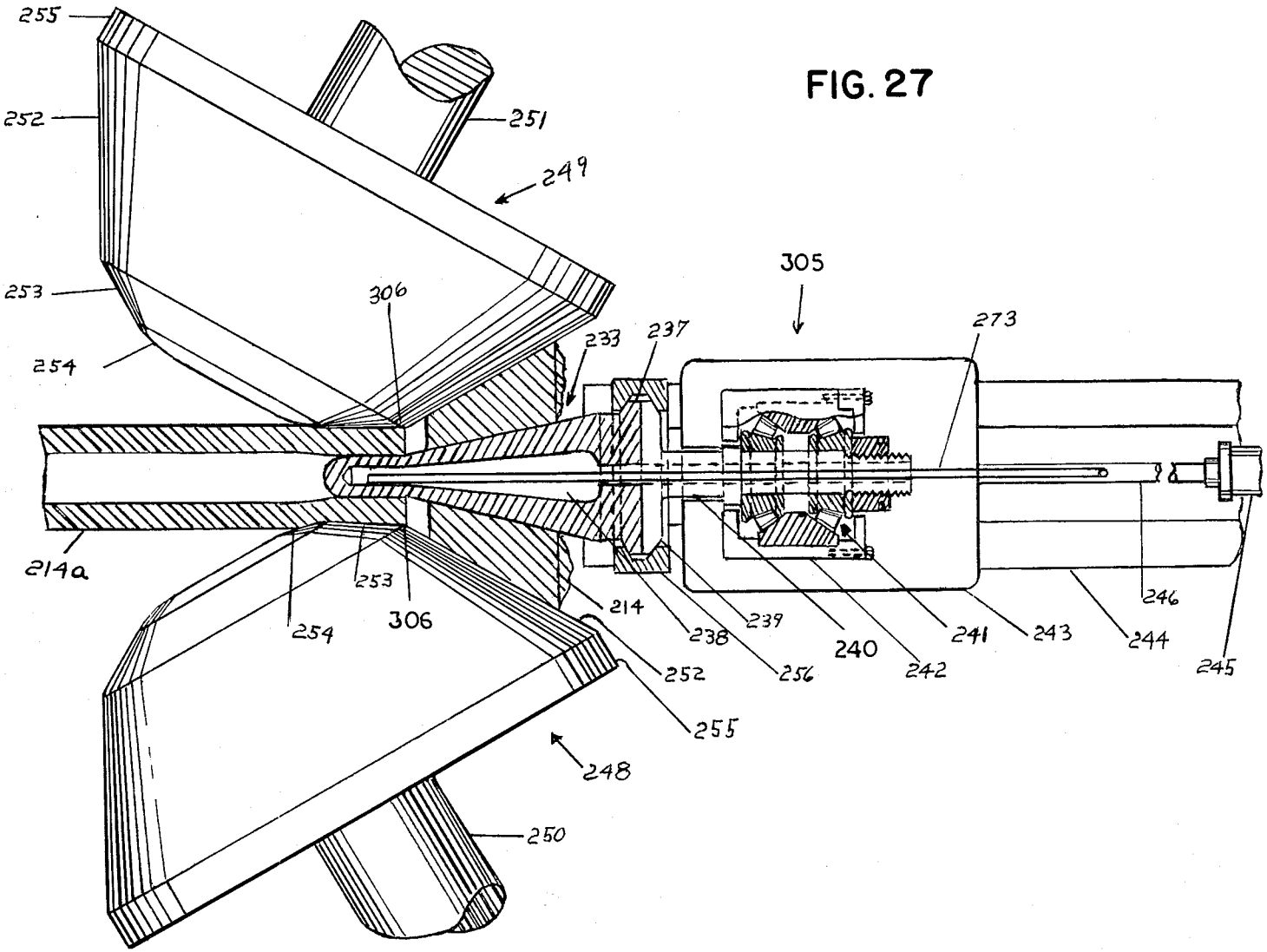
FIG. 27 is a plan view of the Rotary Blooming Mill showing the pressed billet, mandrel and discs at the point of first contact with the discs, and at the point of leaving the discs after being rolled helicoidally into a cylindrical seamless hollow.
Figure 28:
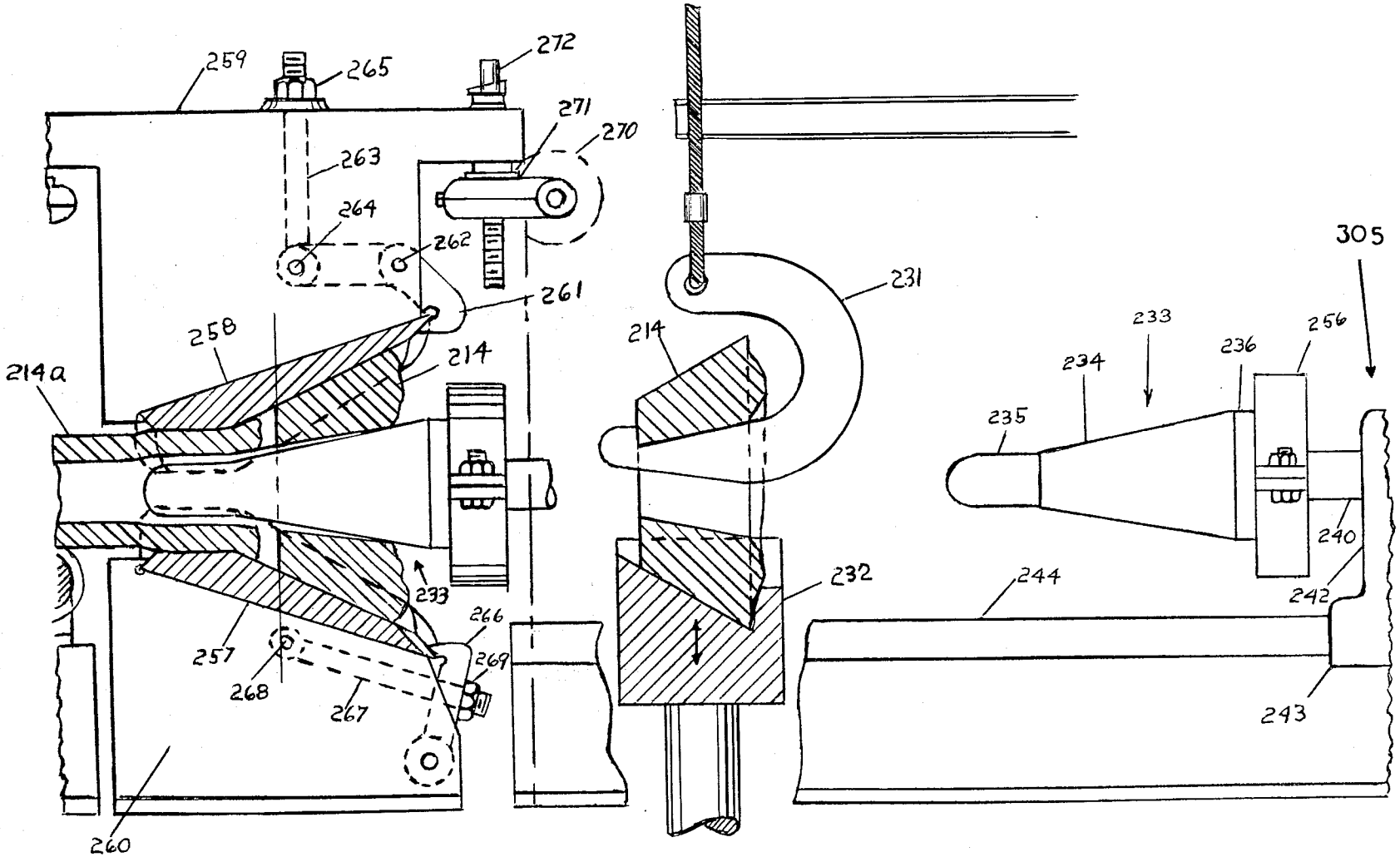
FIG. 28 is an elevation section through the mill showing the mandrel in retracted position, the means of positioning the billet before it is picked up by the forward moving mandrel and moved into the pass for rolling, the guide shoes and the means of mounting them.
Figure 29:
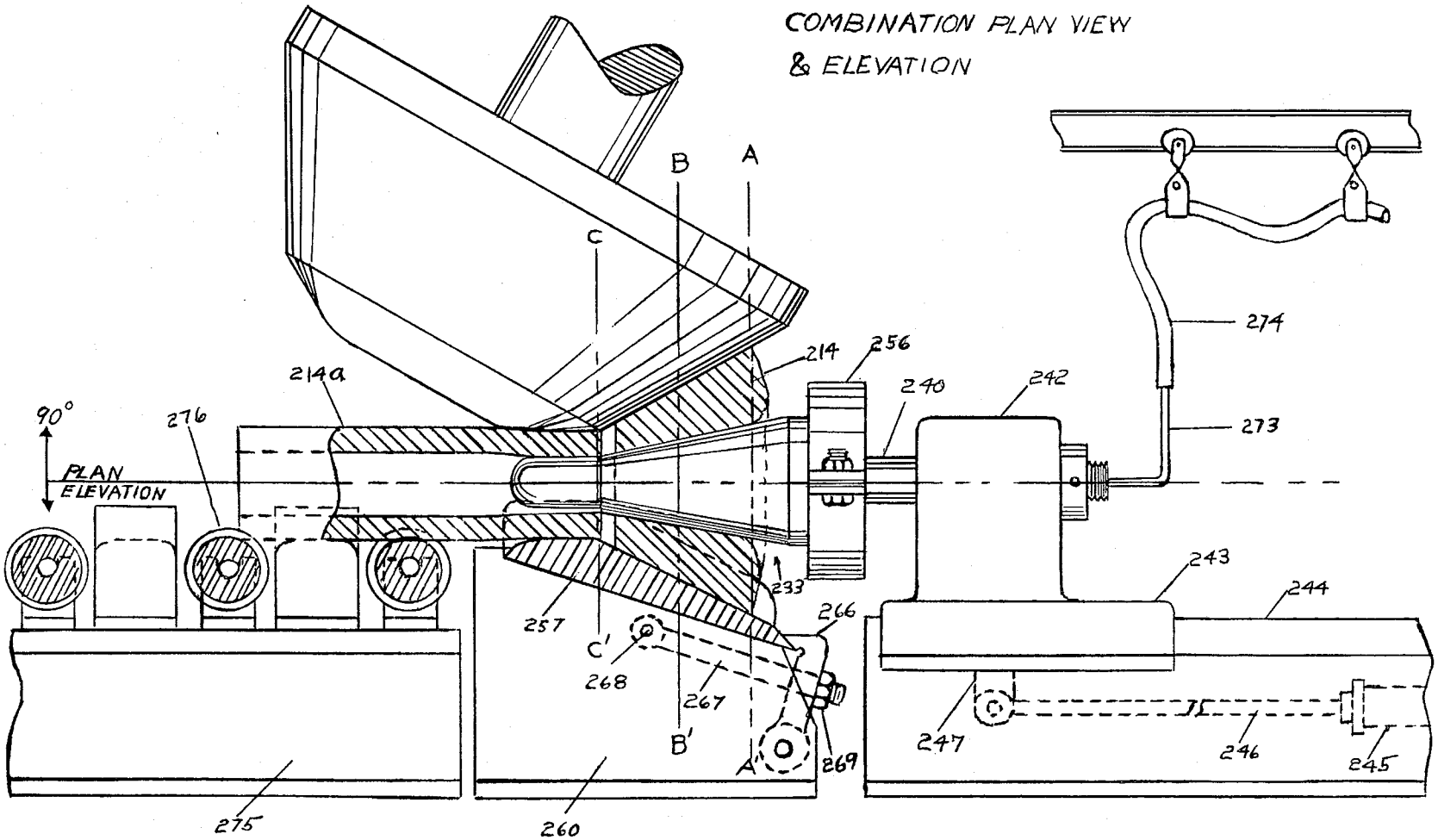
FIG. 29 is a composite plan and elevation of the mill showing the relation between the rolls and guide shoes, and the means of moving the mandrel into and out of the mill pass.

Referring more particularly to FIGS. 27, 28 and 29 for a description of the rolls and their arrangement in the pass: two identical rolls or discs generally designated by 248 and 249 are mounted on journaled shafts 250 and 251, these shafts being placed such that their centerlines intersect the centerline of the pass to make an included angle of about 120°, each making one half of this angle with the pass centerline of about 60°. These discs have working surfaces 252 which, in opposition form an included angle of 60 degrees with each other and each disc an angle of about 30 degrees with the pass centerline. Working surfaces 252 joins parallel reeling surfaces 253 at gorge point 306, surfaces 253 terminating in surfaces 254 which forms such an angle with the axis of the discs that surfaces 254 taper away from each other in the pass to form a relief section that will permit the finished tubular hollow 214*a* to leave the mill pass. Working surfaces 252 terminate in their rearward ends in a cylindrical section 255 that will furnish a reserve section for remachining the discs to restore sections 252, 253 and 254 to their original profile after wear.

The second essential part of the mill pass consists of mandrel 233 which in working position is positioned between disc working surfaces 252, 253 and 254 so that its centerline coincides with the pass centerline. Mandrel 233 consists of a conical working section 234, cylindrical section 235 and cylindrical section 236 (FIGS. 28). Section 236 is joined to mounting flange 237 (FIGS. 27) and clamped in this position by shroud clamp 256. Mandrel 233 is provided with a central cooling cavity 238.

Mandrel 233 is held in position in the rotary roolng pass and allowed to rotate freely by being attached to flange 239, flange 239 being an integral part of spindle 240 which is mounted in roller bearing assembly generally designated by 241. Roller bearing assembly 241 is mounted in housing 242 which is a part of base 243. Base 243 is slidably attached to slides 244 and moved toward and away from the mill pass by cylinder 245 which actuates piston rod 246 which is attached to carriage 243 by tang 247.

Spindle 240 is hollow to admit water pipe 247 to the interior cavity of mandrel 233, water being supplied by hose 274 which is attached to a source of supply.

The third essential part of the rotary rolling pass consists of guide shoes (FIGS. 27 and 28). Bottom guide shoe 257 is mounted on holder 260 and held in position by clamp 266 which is held against the rearward end of the shoe by threaded rod 267 and nut 269, rod 267 being pinned to holder 260 by pin 268. Similarly, top guide shoe 258 is mounted on top holder 259 and clamped in position by clamp 262 which is pinned to top holder 259 by pins 262 and 264, and actuated by draw rod 263 and nut 265. Top holder 259 is adjustable upward and downward by screw 272 which is actuated by gear assembly 271 and motor 270.

The top and bottom guide shoes are identical in design and are, in general, so profiled in lateral and longitudinal section as to keep the advancing and rotating billet in the shape of a cone until it reaches the parallel section of the pass at gorge point 206, the vertical setting to the guide shoes being such that the distance between them at the point of first contact is equal to the horizontal distance between the rolls, the ratio of the vertical distance between the guides to the horizontal distance between the rolls gradually increasing by a slight amount so that the cross section of the tube at the gorge is slightly oval, the major axis of this ovaled profile being vertical. The ovaled profile of tube 214*a* will round up as the tube leaves the mill by action of diverging section 254 of the discs and the inside diameter of tube 214*a* will be larger than the parallel reeling section 235 of mandrel 233.

In operation, reheated billet 214 is transported from a reheating furnace by a crane mounted hook 231 and placed on retractable stool 231 (FIGS. 28) and the hook removed. Carriage 243 is moved forward until mandrel 233 contacts the inside of billet 214 and stool 231 is retracted downward below slides 244. The billet is then moved into the mill pass where it is processed into tubular hollow 214*a*. Rotary motion is provided by the rotation of discs 248 and 249 in the same direction, and forward centerline of one disc is set above the centerline of the mill pass, and the centerline of the other disc set below the mill centerline by the same amount.

The details of the technology and theory of rotary rolling are well known and have not been elaborated here since they have only been briefly described to illustrate the application to my invention.

My method, using my apparatus, is as follows:

The train of buggies is actuated to bring one of the buggies in a position in front of the circular table for the teeming of molten metal, this buggy bearing on its upper surface the assembly of circular metal stool, cylindrical metal mold, and positioned hollow metal core, this hollow core now being connected to high pressure cooling water by actuating the air cylinder to lower the length of pipe bringing the nozzle into engagement with the bevel on top of the hollow metal core and the outer lower surface of the nozzle into contact with the inner surface of the hollow metal core, said high pressure water supply then being turned on. Molten metal is then teemed through a trough, tundish or other auxiliary device directly into the metal mold to the desired height, the flow of molten metal then being interrupted. The turntable is then indexed to bring the next mold into teeming position in continuous operation, the flow of high pressure cooling water being so regulated that the temperature of the surface of the hollow metal core in contact with the molten metal remains between 1600° and 1900° F. until each of the molds is ready to be indexed into position under the core removing hammer at which time the flow of the high pressure cooling water is increased to reduce the temperature of the hollow metal core as near as possible to the ambient temperature of the cooling water, this temperature reduction causing the hollow metal core to decrease in diameter, this reduction in diameter causing the hollow metal core to shrink away from the now solidified portion of the casting formed by contact with the outside surface of the hollow metal core. The flow of cooling water is then interrupted, the length of pipe bearing the special nozzle is raised to vertical position, and the turntable then indexed to bring the buggy with loosened core directly under the core removing hammer. The wedge operated ram mounted in the case of the core removing hammer, is then actuated upward into supportive contact with the under surface of the top member of the buggy, the core retaining key then being withdrawn from contact with a shoulder machined around the outer surface of the metal core, the core removing hammer then being actuated to drive the hollow metal core downward through the casting, the holes in the metal stool and top surface of the buggy, and to a conveyor located under the base of the core removing hammer, the under mounted supportive ram then being lowered. The turnable then is actuated to move the buggy carrying the casting one buggy length past the hammer, past convenient locations on the circular platform where observations may be made of the temperature of the core of the casting and further cooling may be applied by direct spray cooling or air blast to prevent breakout or still molten metal. This indexing by one buggy length eventually brings the buggy carrying the casting from which the core has been removed, to a position ahead of the hydraulic press, the drive bars then coming into contact with the plate cam and raised to and held in vertical position as the buggy moves ahead and eventually under the mandrel of the hydraulic press and above the supportive wedge actuated ram located in the foundation of the press. The supportive ram is then actuated to raise it into contact with the under surface of the top member of the buggy, the press cylinder then being actuated to move downward, the projectile shaped bottom section of the mandrel, and the cylindrical section of the mandrel then converting the slightly conical section of the casting into a cylindrical profile, the succeeding conical section of the mandrel then converting the cylindrical section into a cone of bottom diameter equal to the diameter of the cylindrical section of the mandrel, and of top diameter equal to about one half the outside diameter of the casting at the top. The supportive wedge actuated ram is then withdrawn from contact with the under surface of the top member of the buggy, the mandrel being then withdrawn upward and out of contact with the casting, the buggy then being indexed to carry the forged casting out of the hydraulic press. The drive bars are lowered to drive position by contact with the plate cam, the buggy then being moved by successive indexing of the turntable to a station in front of the circular platform where the mold containing the forged casting is lifted from the buggy to the stripping device which raises the forged casting to a position where it may be grasped by tongs and moved to storage, conditioning, or immediate reheating for forging into a seamless hollow.

I claim:

1. An apparatus for making a billet for a seamless tube rotary rolling mill, comprising a plurality of open-topped molds, upstanding cores removably mounted in said molds, a metal casting station, a core removing station, a forging station including a mandrel shaped to enter core holes formed by removal of said cores in castings in said molds, a mold stripping station, and means for successively moving each of said molds passed said stations, said molds having casting cavity side walls each in the form of an inverted frustrum of a cone and stools forming their cavity bottoms and in which holes are formed and in which said cores are fitted to mount the cores, said mold moving means supporting said stools and providing clearance therebelow for downward movement of said cores, and a hammer mounted above said molds at said core removing station for hammering said cores downwardly through castings formed in said mold cavities, said cores being tubular, and including nozzles inserted in the tops of said cores of said molds, means for moving each of said nozzles with each of said molds, means for automatically inserting said nozzles in said cores of said molds leaving said casting station one after another, means for automatically removing said nozzles from said cores as said molds approach said core removing station and means for supplying said nozzles with water while inserted in said cores.

2. The apparatus of claim 3 having means for locking said cores against downward movement through said holes while said molds approach said casting station and for unlocking said cores after they are held by said castings and prior to actuation of said hammer at said core removing station.

3. The apparatus of claim 3 in which said mold moving means includes buggies having wheels and on which said molds and stools are carried, and having a ram at said core removing station and an actuator for moving said ram supportingly against the bottom of each buggy during actuation of said hammer to relieve said wheels from the hammer stress.

4. The apparatus of claim 3 in which said mandrel has a lead-in section for entering the core holes in said castings followed by a conical section to forge the castings against said cavity side walls, and including a press for pressing said mandrel into said castings.

5. The apparatus of claim 4 in which said mold moving means includes buggies having wheels and on which said molds and stools are carried, and having a ram at said forging station and an actuator for moving said ram supportingly beneath the bottom of each buggy during actuation of said press to relieve said wheels from the pressing stress.

6. The apparatus of claim 3 having a crane at said stripping station for lifting each mold from its stool, and an upward movable stripping stool at this station, said stripping stool having a size substantially fitting the bottom of the mold cavity and on which each mold is placed, said stripping stool being upwardly movable through the mold's bottom to strip the casting therein from the mold's side wall.

7. Apparatus for forming a hollow conical billet suitable for forming into a seamless tubular hollow, comprising a cylindrical metal mold, the inside profile of said metal mold being in the form of an inverted right truncated cone of approximately 60° included angle, said metal mold being placed with axis perpendicular on a flat circular metal stool with the smaller circular opening of said metal mold in contact with the upper plane surface of said stool, said stool having a cylindrical hole extending through its body, the axis of said hole coinciding with the axis of said metal mold, the diameter of said hole in said stool being not greater than six inches less than the inside diameter of said smaller opening of said inside profile of said metal mold in contact with said metal stool, said hole having inserted in it a slidably fitting hollow metal core, said metal core being cylindrical in form in the portion in contact with and extending through said hole in said stool, but slightly conical in profile in the portion extending upward from said stool to a height not less than twelve inches above the top surface of said metal mold, the taper on diameter of said conical section being not less than three quarters of an inch per linear foot on diameter taken parallel to the axis of said metal core, said metal core having an inside cylindrical hollow extending through its length, said cylindrical hollow terminating on the upper circular plane end of said metal core in a bevel, the assembly of metal stool, metal mold and hollow metal core being placed on the plane top surface of a horizontal top member of a buggy, said metal horizontal top member of said buggy being provided with a cylindrical hole extending through said horizontal top member of said buggy, the diameter of said hole being such that it provides a sliding fit with said cylindrical portion of said hollow metal core, said cylindrical portion of said metal core is flush with the bottom plane surface of said horizontal top member of said buggy, said cylindrical portion of said metal core having a shoulder machined around its outer circumference at a point located at a distance upward from the bottom of said cylindrical portion of said metal core approximately equal to one half the thickness of said horizontal top member of said buggy, said horizontal top member of said buggy being provided with a horizontal hole machined radially edgewise in said top member of said buggy approximately one half way between said top and bottom plane surfaces of said horizontal member in exact register with said shoulder on said cylindrical section of said hollow metal core, said hole containing a slidably fitting rod that can be mechanically thrust into said groove of rectangular cross section machined into said cylindrical section of said hollow metal core, said hollow metal core being in position in said assembly of metal mold, metal stool and buggy, said metal rod also capable of being mechanically withdrawn from contact with said shoulder, the effect of said withdrawal of said rod being to release said hollow metal core from said metal mold.

8. Apparatus for forming a hollow conical billet as defined in claim 7 having a series of said molds and stools, cores and buggies, all of which are duplicates of each other, said buggies being provided with a plurality of flanged wheels mounted on the underside of said buggies, said flanged wheels resting on a circular track of sufficient diameter to accommodate said series of duplicate buggies, said buggies being coupled together in a continuous train capable of being moved around said circular track.

9. Apparatus for forming a hollow conical billet as defined in claim 8, said circular track being surrounded by a circular platform close to, but not in contact with said continuous train of buggies, said circular platform serving as a location for placing, removing and servicing of said molds, said circular platform further serving as a location for teeming of hot metal into said molds, and stripping finished castings from said molds.

10. Apparatus for forming a hollow conical billet as defined in claim 9, said circular table being broken to provide a space at specified points around its circumference to provide space in which an air hammer is positioned, said air hammer having a piston, ram and hammer and being cantilevered over said continuous train of buggies such that the centerline of the piston, ram and head of said hammer will intersect the circle joining the centerlines of all said molds, said air hammer being further provided with a wedge actuated ram that may be moved upward into contact with, or downward out of contact with the under side of said top member of said buggies.

11. Apparatus for forming hollow conical billet as defined in claim 10, said circular table being further broken to provide space in which is positioned by hydraulic press, said press consisting of a hydraulic cylinder mounted on top of four columns, said columns being placed two on the inside of said circular train of buggies, and two on the outside of said circular train of buggies, said cylinder being connected to a platen slidably mounted under said cylinder on said four columns, said platen bearing a mandrel on its under side, the centerline of said mandrel intersecting the horizontal circular joining vertical centerlines of said molds, said mandrel consisting of a projectile shaped section on its bottom extremity, said projectile shaped section being joined to a cylindrical section, said cylindrical section being equal in diameter to said diameter of said hollow metal core minus sliding clearance, the length of said cylindrical section of said mandrel being equal to the height of said metal mold, said cylindrical section of said mandrel joining a tapered or conical section, the length of said tapered or conical section being twenty to thirty percent greater than the height of said metal mold, the concentricity of said tapered or conical section of said mandrel being such that the diameter of said tapered or conical section of said mandrel in a plane defining the top of said metal mold will be approximately equal to one half of the inside diameter of said metal mold, said tapered or conical section of said mandrel terminating in a cylindrical section, said cylindrical section bearing devices for attachment of said mandrel to said platen, said hydraulic press being further provided with a wedge operated ram in its base that may be actuated upward and downward into and out of contact with the upper surface of said top member of said buggies.

12. Apparatus for forming a hollow conical billet as defined in claim 11, said circular train or buggies having positioned on its inner circumference a circular turntable, the outer circumference of said turntable being separated from the inner circumference of said train of buggies by a gap sufficient to clear said columns of said hydraulic press, said circular turntable consisting of a plurality of structural members disposed radially outward in the same horizontal plane from a central hub, said structural members being tied together from the outer circumference of said turntable inward by structural members including a top plate, and a bottom plate, said structural members being tied together in the center by being secured to said central hub, said central hub resting on a central bearing, said turntable being supported on its outer circumference by a series of flanged wheels, said flanged wheels being mounted on said bottom plate of said turntable by housing, journals and axles, said wheels resting on a continuous circular rail, said circular rail having the same center as said turntable, said bottom plate of said turntable being further provided with a ring gear, said ring gear being engaged by a motor driven pinion to rotate said turntable.

13. Apparatus for forming a hollow conical billet as defined in claim 12, said turntable carrying on its upper surface an assembly for each of said molds for conducting high pressure cooling water to the inner surface of said hollow metal core, said assembly consisting of a flanged column mounted upright on said upper surface of said turntable, said flanged column being surmounted by a clevis, said clevis being pinned to a cooling arm, said cooling arm consisting principally of a length of pipe bearing on one end a tang to which said clevis is pinned such that said length of pipe is capable of being swiveled about said pin in a vertical plane from a horizontal to a vertical position, said length of pipe bearing on its opposite free end of nozzle having a bevel on its outer surface, said nozzle being so mounted that when said horizontal length of pipe is in horizontal position, the axis of said nozzle will be coincident with the axis of said hollow metal core and said bevel on the outer surface of said nozzle will engage the top of said cylindrical hollow in said hollow metal core, said top having a mating bevel fitting the first-named bevel, said nozzle being further provided with orifices formed to cause high pressure water issuing therefrom to flow tangent to the inner surface of said cylindrical hollow in said hollow metal core and take a spiral path downward through said cylindrical hollow until it encounters deflecting vanes located in the bottom portion of said cylindrical hollow in said hollow metal core, said deflecting vanes causing said tangential flow of said high pressure cooling water to flow parallel to the axis of said hollow metal core, said cooling water being originally conducted from the interior of said length of pipe solely through an arched conductor, said conductor being arched upward from the top of said length of pipe and communicating with the interior of said length of pipe, the other end of said conductor being connected to the hollow end of said special nozzle, said arched conductor serving as a trap to prevent flow of water by gravity from said pipe member to said nozzle when the water supply to the length of pipe is interrupted, a supply of high pressure water being conducted to the inside of said length of pipe through a hose connection attached to the end of said length of pipe opposite to the end bearing said nozzle and communicating with the inside of said length of pipe, said hose connection being connected to a hose attached to an electromagnetic valve, said valve being mounted on and connected to a ring shaped tubular manifold, said ring shaped tubular manifold being mounted on the surface of said turntable and connected to a centrally located swivel joint, said swivel joint being connected to a primary source of high pressure water, said length of pipe being further fitted with a vertically extending lever arm mounted on top of the pinned end of said length of pipe, said lever arm being connected by a pin to a clevis mounted on the end of the piston rod of an air cylinder, said air cylinder being trunnion mounted to a frame, said frame being bolted to the top surface of said turntable, said air cylinder being supplied with high pressure air to either side of its piston through hoses, said hoses being connected to an electromagnetic valve that may be actuated to introduce high pressure air to either side of said piston of said cylinder, said electromagnetic valve being mounted on and connected to a ring shaped tubular manifold mounted on the surface of said turntable, said ring shaped tubular manifold being connected to a centrally located swivel joint, said swivel joint being connected to a primary source of high pressure air, said swivel joints being incorporated into one unit serving to separate air and water, said unit being located in the center of said turntable and being incorporated into said central hub of said turntable.

14. Apparatus for forming a hollow conical billet as defined in claim 13, said turntable being further provided with a means of positive engagement and disengagement with said train of buggies, said means of positive engagement and disengagement consisting of a plurality of flat rectangular bars, one in number for each of said buggies, said flat rectangular bars being hinged to a plate fastened to said top plate of said turntable, each of said flat rectangular bars being of such a length as to enable it to extend over the space between said turntable and said train of buggies, and of such a width as to enable each of said flat rectangular bars to rest on a portion of the top surface of two adjacent buggies and in contact with lugs affixed to said top surface of said buggies such that when said turntable is set in rotation, said rotation will be transmitted through said flat rectangular bars to said train of buggies and tow them around said circular track, said towing action being imparted simultaneously to such of said buggies as are not between said columns of said hydraulic press, the positioning of two of said columns between said turntable and said train of buggies requiring that said flat rectangular bars be raised to the vertical by rotation about said hinged plate and held in vertical position until each of said buggies is moved past said columns of said hydraulic press then lowered into horizontal position against said top surface of said buggies in contact with said lugs affixed to said top surface of said buggies, said raising to a vertical position, holding in vertical position, and lowering again to horizontal position being accomplished by contact with a profiled plate cam mounted between said turntable and said circular platform, said plate cam being so profiled that its upper surface will bear on the under surface of said flat rectangular bar and cause the said raising to vertical position, holding in vertical position, and lowering to horitontal position as each of said buggies in said train of buggies is towed past said press columns.

* * * * *